US010215168B2

(12) United States Patent
Marsh

(10) Patent No.: US 10,215,168 B2
(45) Date of Patent: Feb. 26, 2019

(54) MICROELECTROMECHANICAL SYSTEMS FABRICATED WITH ROLL TO ROLL PROCESSING

(71) Applicant: Stephen Alan Marsh, Carlisle, MA (US)

(72) Inventor: Stephen Alan Marsh, Carlisle, MA (US)

(73) Assignee: Encite LLC, Burlington, MA (US)

( * ) Notice: Subject to any disclaimer, the term of this patent is extended or adjusted under 35 U.S.C. 154(b) by 434 days.

(21) Appl. No.: 14/927,121

(22) Filed: Oct. 29, 2015

(65) Prior Publication Data

US 2016/0131126 A1 May 12, 2016

Related U.S. Application Data

(60) Provisional application No. 62/073,092, filed on Oct. 31, 2014.

(51) Int. Cl.

| | |
|---|---|
| ***F04B 43/00*** | (2006.01) |
| ***F04B 19/00*** | (2006.01) |
| ***F04B 43/04*** | (2006.01) |

(52) U.S. Cl.

CPC ..... *F04B 43/043* (2013.01); *F04B 19/006* (2013.01)

(58) Field of Classification Search

USPC ..... 156/154

See application file for complete search history.

(56) References Cited

U.S. PATENT DOCUMENTS

| | | | | |
|---|---|---|---|---|
| 5,687,767 | A | 11/1997 | Bowers | |
| 5,836,750 | A | 11/1998 | Cabuz | |
| 6,106,245 | A | 8/2000 | Cabuz | |
| 6,179,586 | B1 | 1/2001 | Herb | |
| 6,247,908 | B1 | 6/2001 | Shinohara | |
| 6,261,066 | B1 | 7/2001 | Linnemann | |
| 6,443,154 | B1 | 9/2002 | Jalde | |
| 6,568,286 | B1 | 5/2003 | Cabuz | |
| 6,758,107 | B2 | 7/2004 | Cabuz | |
| 6,889,567 | B2 | 5/2005 | Cabuz | |
| 7,090,471 | B2 | 8/2006 | Xie et al. | |
| 7,802,970 | B2 | 9/2010 | Singhal et al. | |
| 2002/0029814 | A1* | 3/2002 | Unger | B01L 3/502707 137/824 |

(Continued)

FOREIGN PATENT DOCUMENTS

| | | |
|---|---|---|
| CN | 1338031 | 2/2002 |
| CN | 100402850 | 7/2008 |

(Continued)

OTHER PUBLICATIONS

International Search Report and Written Opinion, PCT/US2015/058222.

(Continued)

*Primary Examiner* — Jeffry H Aftergut

(74) *Attorney, Agent, or Firm* — Fish & Richardson P.C.

(57) ABSTRACT

Roll to roll processing techniques are described to produce microelectromechanical systems having releasable and moveable mechanical structures. A micro-pump that includes a pump body having compartmentalized pump chambers, with plural inlet and outlet ports and valves and plural membranes enclosing the pump chambers is described as a representative example.

20 Claims, 27 Drawing Sheets

(56) References Cited

U.S. PATENT DOCUMENTS

| | | | | |
|---|---|---|---|---|
| 2003/0106799 | A1 | 6/2003 | Covington et al. | |
| 2003/0231967 | A1 | 12/2003 | Najafi et al. | |
| 2004/0103899 | A1 | 6/2004 | Noble | |
| 2004/0115068 | A1 | 6/2004 | Hansen et al. | |
| 2009/0074595 | A1 | 3/2009 | Chen et al. | |
| 2009/0129952 | A1 | 5/2009 | Patrascu et al. | |
| 2009/0130607 | A1* | 5/2009 | Slafer ..... | B82Y 10/00 430/323 |
| 2010/0181871 | A1 | 7/2010 | Daniel et al. | |
| 2011/0207328 | A1 | 8/2011 | Speakman | |
| 2014/0147346 | A1 | 5/2014 | Chitnis et al. | |

FOREIGN PATENT DOCUMENTS

| | | | |
|---|---|---|---|
| CN | 101389200 | | 3/2009 |
| CN | 101526078 | | 9/2009 |
| SU | 1756618 | | 8/1992 |
| WO | WO2009/094572 | A1 | 7/2009 |
| WO | 2013/046330 | | 4/2013 |
| WO | WO2014/016562 | | 1/2014 |

OTHER PUBLICATIONS

OA & Search Report, Chinese Application No. 201580067081X, dated Jun. 27, 2018.

http://www.murata-ps.com/emena/2012-05-22.html 2 pages.

International Search Report and Written Opinion, PCT/US2015/058222, dated Jan. 21, 2016.

International Preliminary Report on Patentability, PCT/US2015/058222, dated May 11, 2017.

PCT/US15/17973 Int'l Search Report and Written Opinion, dated Jul. 14, 2015.

* cited by examiner

MICROELECTROMECHANICAL SYSTEMS FABRICATED WITH ROLL TO ROLL PROCESSING

This application claims priority under 35 U.S.C. § 119 to U.S. Provisional Patent Application Ser. No. 62/073,092, filed Oct. 31, 2014, and entitled "Micro Pump Systems", the entire contents of which is hereby incorporated by reference.

INTRODUCTION

This specification relates to microelectromechanical systems.

Microelectromechanical systems (MEMS) is the name given to a technology in which electro-mechanical components of micro-meter size are fabricated on substrates of silicon using silicon semiconductor process lines that are commonly used in semiconductor device fabrication, i.e. deposition of material layers that are patterning by photolithography and etching processing, polymers using processes such as injection molding, embossing or stereo-lithography (3D printing) especially for microfluidic applications, and metals that are deposited by electroplating, evaporation, and sputtering processes. Ceramics such as nitrides of silicon, aluminum and titanium as well as silicon carbide and other ceramics materials properties. Microelectromechanical systems typically include a central unit that processes data and several components that interact with surroundings. Examples of microelectromechanical systems include micro-sensors (bio, chemical and mechanical), various types of structures and micro-actuators.

SUMMARY

Described are roll to roll fabrication techniques for producing microelectromechanical systems (MEMS) such as a micro-pump. Roll to roll processing can be used to manufacture a variety of microelectromechanical systems (MEMS). Disclosed are specific roll to roll fabrication techniques to produce mechanical structures that are releasable mechanical structures and moveable, mechanical structures in the specific microelectromechanical systems, which specific parts to move in operation of the microelectromechanical systems.

According to an aspect, a method of manufacturing a microelectromechanical system that a fixed body element and a releasable and moveable feature in association with the fixed body element includes patterning a first sheet of a flexible plastic material having a metal coating on one surface of the sheet to produce a first metallic region on the one surface, patterning the first sheet to produce the fixed body element from the first sheet of flexible plastic material and the releasable and moveable feature from the portion of the first sheet having the first metallic region, with the patterning of the releasable and moveable feature leaving the releasable and moveable feature tethered to a portion of the fixed body element, and laminating a second sheet of a flexible plastic material to the first sheet to provide a composite laminated structure.

The following are some embodiments within the scope of this aspect.

In the method the microelectromechanical system is a micro-pump, and the fixed body element is a pump body and the releasable and moveable element is a valve element. The patterning of the first sheet includes ablating, and produces the first metallic region and a second metallic region on the first sheet, with the moveable, releasable element being a first moveable, releasable element and the micro pump comprising a second moveable, releasable element patterned from the portion of the first sheet having the second metallic region, with the first and second moveable, releasable elements being valve elements at inlets and outlets of the pump body. The moveable, releasable elements are a T-shaped member of a T valve and an Omega-shaped member of an Omega valve. The method further includes depositing on the second sheet of a conductive layer on a first surface of the second sheet. The depositing of the conductive layer occurs prior to lamination of the second sheet.

The microelectromechanical system is fabricated on a roll to roll processing line, and the method further includes removing the first sheet of the flexible plastic material having the metal coating from a first roll; and removing the second sheet of the flexible plastic material having a metal coating on one surface from a second roll; and wherein ablating occurs at a first station, patterning occurs at a second station, and lamination occurs at a third station. The method further includes depositing on the second sheet of a conductive layer on a first surface of the second sheet and patterning the conductive layer on the second sheet to provide isolated regions of the conductive layer that provide electrodes on the second sheet. The method further includes dicing the composite laminated structure into individual dies comprising the fixed body element and the releasable and moveable feature, stacking the individual dies to produce a stacked structure, and laminating the stacked structure to produce a component of the microelectromechanical system. The microelectromechanical system is a micro-pump, and the fixed body element is a pump body and the releasable and moveable element is a valve element; with patterning of the first sheet comprises ablating, for producing the first metallic region and a second metallic region on the first sheet, with the moveable, releasable element being a first moveable, releasable element and the micro pump comprising a second moveable, releasable element patterned from the portion of the first sheet having the second metallic region, with the first and second moveable, releasable elements being valve elements at inlets and outlets of the pump body.

According to an aspect, a method of manufacturing a microelectromechanical system in a roll to roll processing line includes unrolling from a first roll a first web of a flexible material having a metal coating on one surface of the sheet, unrolling from a second roll a second web of a flexible material, producing at a first patterning station a body element and a moveable element from the second sheet of material as the sheet traverses through the first patterning station, unrolling from a third roll a third web of a flexible material having a metallic layer on the third sheet and laminating at a laminating station the third web to the second web.

The following are some embodiments within the scope of this aspect.

The microelectromechanical system is a micro-pump and the moveable, releasable element is a valve element. The micro-pump and two moveable, releasable elements that are valve elements at inlets and outlets of the body that is a pump body. The method further includes applying a sacrificial filling material to the body element and moveable element and after laminating, removing the sacrificial filling material with a suitable solvent.

One or more aspects may include one or more of the following advantages.

With these techniques, microelectromechanical systems such as micro-sensors, micro actuators, micro pumps are fabricated with releasable and moveable (freely moveable and well as bendable) features that can be made by techniques such as roll to roll processing. Such microelectromechanical systems having such features can be fabricated in a very inexpensive manner using roll to roll (R2R) processing.

The details of one or more embodiments of the invention are set forth in the accompanying drawings and the description below. Other features, objects, and advantages of the invention are apparent from the description and drawings, and from the claims.

DESCRIPTION OF DRAWINGS

FIGS. 13A-13D are views of a roll to roll implementation for constructing a device with releasable and moveable features.

FIG. 13A-1 is a blown up view of a portion of FIG. 13A.

DETAILED DESCRIPTION

Overview

Microelectromechanical systems such as micro-sensors, micro actuators of which a micro pump as discussed below are fabricated by roll to roll processing.

Microelectromechanical systems can be lab-on-a-chip systems, can be used in fuel cells, high flux electronic cooling systems, and biochemistry systems. The microelectromechanical systems such as micro pumps can transport fluids, e.g., gas or liquids, in small, accurately measured quantities. The micro pumps can be used in various applications. As being fabricated with roll to roll techniques these devices can be made very inexpensively.

Micro Pump Systems

Micro Pumps

Microelectromechanical systems fabricated by roll to roll processing will now be described in conjunction with the micro-pump example.

Figures 1, 13A:
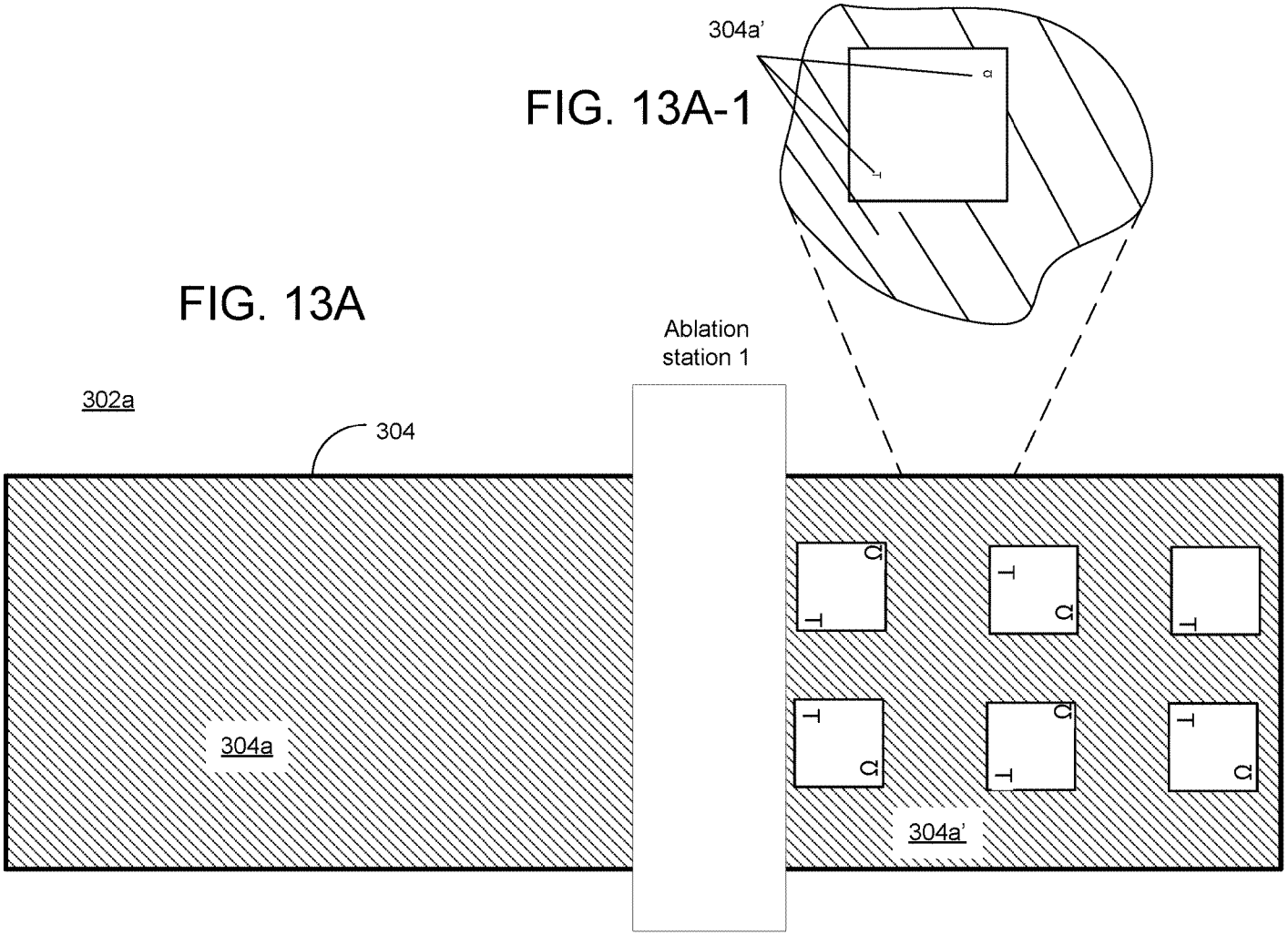

FIG. 1 shows a micro pump 100 that includes a single compartmentalized pump chamber 104. The pump body 102 includes two walls 110, 112 along the pumping direction 114, and two fixed end walls 106, 108 opposite to each other along a direction perpendicular to the pumping direction 114. The walls 106, 108, 110 and 112 define the single chamber 104 that is compartmentalized by membranes. That is, between the two end walls 106, 108, membranes 116, 118, 120, 122, 124, 126 extend from the wall 110 to the wall 112, separating the pump chamber 104 into seven compartments 130, 132, 134, 136, 138, 140, 142. In this implementation, each compartment includes an inlet and an outlet defined in the walls 110, 112, respectively. For example, the compartment 130 includes an inlet 150 in the wall 110 and an outlet 152 in the wall 112. Other inlets and outlets are not labeled.

The compartments 130-142 are fluidically sealed from each other. In some implementations, different compartments can have the same inlet and/or the same outlet (not shown in the figure) and these different compartments may fluidically communicate with each other. Two compartments 130, 142 at the opposite ends of the pump chamber 104 have walls provided by a fixed wall of the pump body 102 and a membrane. All other intermediate compartments between the compartments 130, 142 have walls formed of two membranes. In some embodiments at least one intermediate compartment has compartment walls formed of two membranes. Although six membranes are shown in the figures, the pump chamber can be extended with additional intermediate compartments. An electrode (not explicitly shown in FIGS. 1A and 1B, see, FIGS. 2A and 2C) is attached to each of the membranes 116-126 and optionally to the end walls caps 106, 108.

The electrodes are connected to a drive circuit (see FIGS. 3-5), that delivers voltages to the electrodes to activate the membranes through electrostatic attraction/repulsion. Without activation, the membranes rest at nominal positions identified by the dotted lines in the figures. Each membrane at rest can be substantially parallel to the end walls 106, 108 and the compartments 132-140 can have the same nominal volume $V_i$. For example, the distance between two adjacent membranes in their nominal positions is about 50 microns, and the nominal volume $V_i$ can range from nanoliters to microliters to milliliters, e.g., 0.1 microliters.

In some implementations, the compartments 130, 142 each has a nominal volume $V_e$ that is half the nominal volume of the intermediate compartments 132-140. For example, the distance between the membrane 116 in its nominal position and the end wall 106 or between the membrane 126 in its nominal position and the end wall 108 is about 25 microns. The nominal volume $V_e$ can range from nanoliters to microliters to milliliters, e.g., 0.05 microliters. The compartments 130-142 can also have different sizes. The sizes are chosen based on, e.g., specific process requirements of a roll to roll manufacturing line, as well as, power consumption, and application considerations.

For example, the compartments 130, 142 having a width of 25 microns can allow a start-up function with a reduced peak drive voltage. Drive voltages are discussed further below. As an example, the micro pump can have an internal volume having a length of about 1.5 mm, a width of about 1.5 mm, a total height (the cumulative height of different compartments) of 0.05 mm, and a total volume of about 0.1125 $mm^3$.

Compared to a conventional pump used for similar purposes, the micro pump uses less material that is subject to less stress, and is driven using less power. The micro pump has a size in the micron to millimeter scale, and can provide wide ranges of flow rates and pressure. Approximately, a flow rate provided by a micro pump can be calculated as:

The total volume of the micro pump×drive frequency.

Generally, the flow rate can be in the scale of microliters to microliters. Generally, the pressure is affected by how much energy, e.g., the drive voltage, is put into the micro pump. In some implementations, the higher the voltage, the larger the voltage, and the upper limit on voltage is defined by break down limits of the micro pump and the lower limit on the voltage is defined by the membrane's ability to actuate. The pressure across a micro pump can be in the range of about micro psi to tenths of a psi. A selected range of flow rate and pressure can be accomplished by selection of pump materials, pump design, and pump manufacturing techniques. The described micro pump is a displacement type pump in the reciprocating category. Pumping occurs in two alternating operations including fluid, e.g., gas or a liquid, charging and fluid discharging through the actuation of a pump chamber of the micro pump. In the charging operation, the pump chamber is opened to a lower pressure source and the fluid fills into the chamber. In the discharging operation, the fluid inside the pump chamber is compressed out of the pump chamber to a higher pressure sink.

Figure 1A:
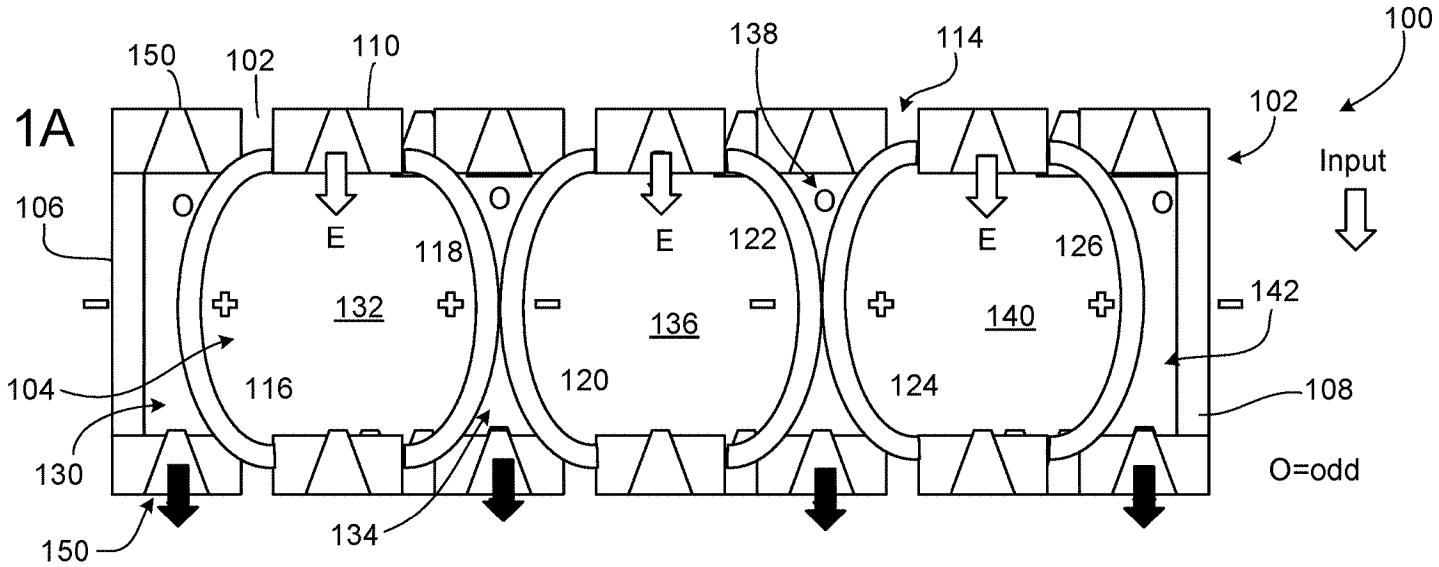
FIGS. 1A and 1B are functional block diagrams of a microelectromechanical system as a micro pump operating in two opposite phases of a pumping cycle.
Figure 1B:
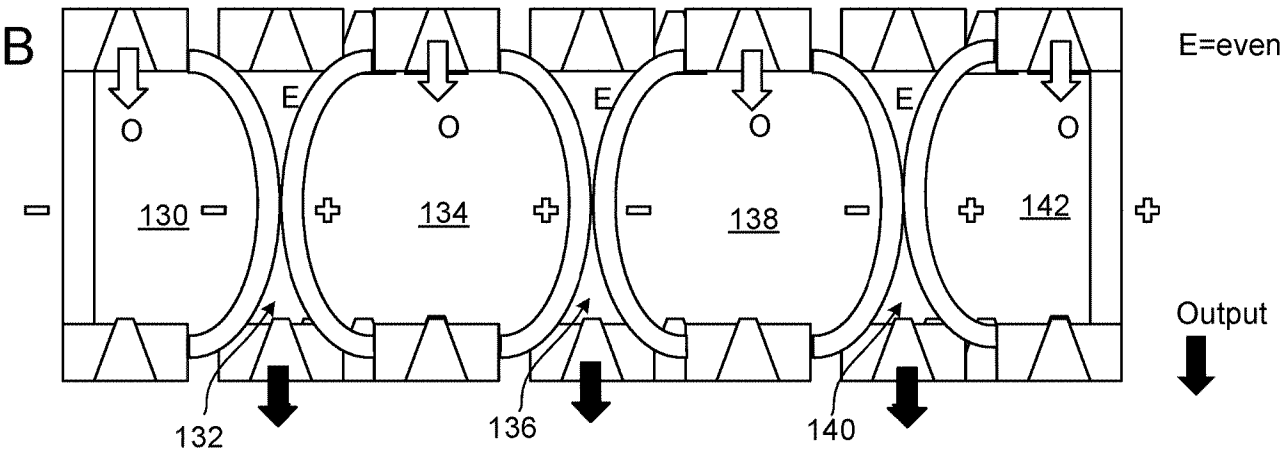

FIGS. 1A and 1B show two operational states of the same pump, a compartment is compressed when adjacent membranes move towards each other and reduce the volume of the compartment to discharge gas from the compartment. Simultaneous to the compression of that compartment, adjacent compartments are charged when its two membranes move away from each other to expand the chamber volume. When actuated, each membrane of the pump chamber can move in two opposite directions about a central, nominal location at which the membrane rests when it is not actuated.

In operation, the membrane of the conventional pump chamber forms a single pump chamber compartment, which is used in pumping. Gas is charged and discharged once during the charging and discharging operations of a pumping cycle, respectively. The gas outflows only during half of the cycle, and the gas inflows during the other half of the cycle.

In the instant micro pump, each compartment is used in pumping. For example, two membranes between two fixed end walls form three compartments for pumping. The micro pump can have a higher efficiency and can consume less energy than a conventional pump performing the same amount pumping, e.g., because the individual membranes travel less distance and therefore are driven less. The efficiency and energy saving can further increase when the number of membranes and compartments between the two fixed end walls increases.

Generally, to perform pumping, each compartment includes a gas inlet and a gas outlet. The inlet and the outlet can include a valve, e.g., a passive valve that opens or closes in response to pressure applied to the valve. In some implementations, the valves are flap valves and are driven by a differential pressure across the valves created by flow of gas in or out of the pump compartment. Because no active driving is required, the flap valves can reduce the complication of pump operation. Alternatively, it is also possible to build a micro pump in a valve-less fashion using nozzles and diffusers.

Generally, the membranes are driven to move by electrostatic force. An electrode can be attached to each of the fixed end walls and the membranes. During the charging operation of a compartment, the two adjacent electrodes of the compartment have the same positive or negative voltages, causing the two electrodes and therefore, the two membranes to repel each other. During the discharging operation of a compartment, two adjacent electrodes of the compartment have the opposite positive or negative voltages, causing the two electrodes and therefore, the two membranes to attract to each other.

The two electrodes of a compartment form a parallel plate electrostatic actuator. The electrodes generally have small sizes and low static power consumption. A high voltage can be applied to each electrode to actuate the compartment. But the actuation can be performed at a low current.

As described previously, each membrane of the micro pump moves in two opposite directions relative to its central, nominal position. Accordingly, compared to a compartment in a conventional pump, to expand or reduce a compartment by the same amount of volume, the membrane of this specification travels a distance less than, e.g., half of, the membrane in the conventional pump. As a result, the membrane experiences less flexing and less stress, leading to longer life and allowing for greater choice of materials. In addition, because the travel distance of the membrane is relatively small, the starting drive voltage for the electrode on the membrane can be relatively low. Accordingly, less power is consumed. For a compartment having two membranes, since both membranes are moving, the time it takes to reach the pull-in voltage can be shorter.

A drive circuit for applying voltages to the electrodes takes a low DC voltage supply and converts it to an AC waveform. The frequency and shape of the waveform can be controlled by a voltage controlled oscillator. The drive voltage can be stepped up by a multiplier circuit to the required level.

Microelectromechanical systems such as micro pumps having the above described features are fabricated using roll to roll (R2R) processing. Roll-to-roll processing is becoming employed in manufacture of electronic devices using a roll of flexible plastic or metal foil as a base or substrate layer. Roll to roll processing has been used in other fields for applying coatings and printing on to a flexible material delivered from a roll and thereafter re-reeling the flexible material after processing onto an output roll. After the material has been taken up on the output roll or take-up roll the material with coating, laminates or print materials are diced or cut into finished sizes.

Below are some example criteria for choosing the materials of the different parts of the micro pump.

Pump body and valves—The material used for the body of a pump may be defined by the requirements of the integrated flap valves, if the flap valves are made of the same material as the body. In some implementations, the material needs to be strong or stiff enough to hold its shape to provide the pump chamber volume, yet elastic enough to allow the flap valves to move as desired. In addition, the choice can be influenced by the geometric design of the flap valves. In some implementations, the material is etchable or photosensitive so that its features can be defined and machined/developed. Sometimes it is also desirable that the material interact well, e.g., adheres with the other materials in the micro pump. Furthermore, the material is electrically nonconductive. Examples of suitable materials include SU8 (negative epoxy resist), and PMMA (Polymethyl methacrylate) resist.

Membrane—The material for this part forms a tympanic structure (a thin tense membrane covering the pump chamber) that is used to charge and discharge the pump chamber. As such, the material is required to bend or stretch back and forth over a desired distance and has elastic characteristics. The membrane material is impermeable to fluids, including gas and liquids, is electrically non-conductive, and possesses a high breakdown voltage. Examples of suitable materials include silicon nitride and Teflon.

Electrodes—This structures are very thin and comprised of material that is electrically conductive. Because the electrodes do not conduct much current, the material can have a high electrical resistance, although the high resistance feature is not necessarily desirable. The electrodes are subject to bending and stretching with the membranes, and therefore, it is desirable that the material is supple to handle the bending and stretching without fatigue and failure. In addition, the electrode material and the membrane material will need to adhere well to each other, e.g., will not delaminate from each other, under the conditions of operation. Examples of suitable materials include gold, and platinum.

Electrical interconnects—The drive voltage is conducted to the electrode on each membrane of each compartment. Electrically conducting paths to these electrodes can be built using conductive materials, e.g., gold, and platinum.

In FIGS. 2A-2D, a modularized micro pump is shown.

Figure 2A:
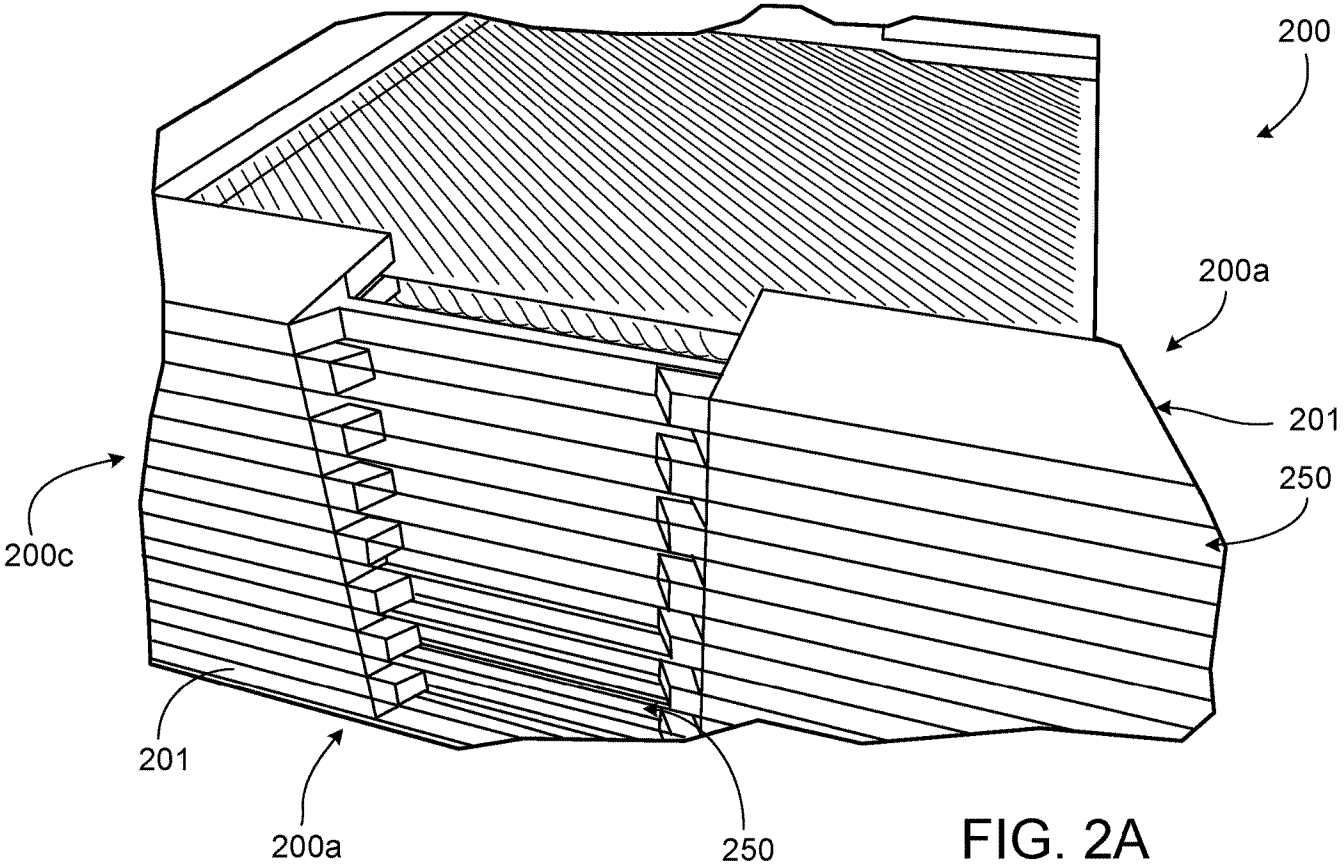
FIG. 2A is an assembled view of a stack of assembled module layers.

Referring to FIG. 2A a modularized micro pump 200 is comprised of module layers 201 (FIGS. 2B and 2C) to form end compartments 200*a*, 200*b* of the pump 200. The modularized micro pump 200 is also comprised of many module layers 250 (FIG. 2D) to form intermediate compartments 200*c* of the pump 200.

The valves in the micro pump 200 can be replaced by single valves connected to the input and the output or the individual valves in each layer can be staggered. Specific details on modularized micro pump fabrication with roll to roll processing are discussed below.

Figure 2B:
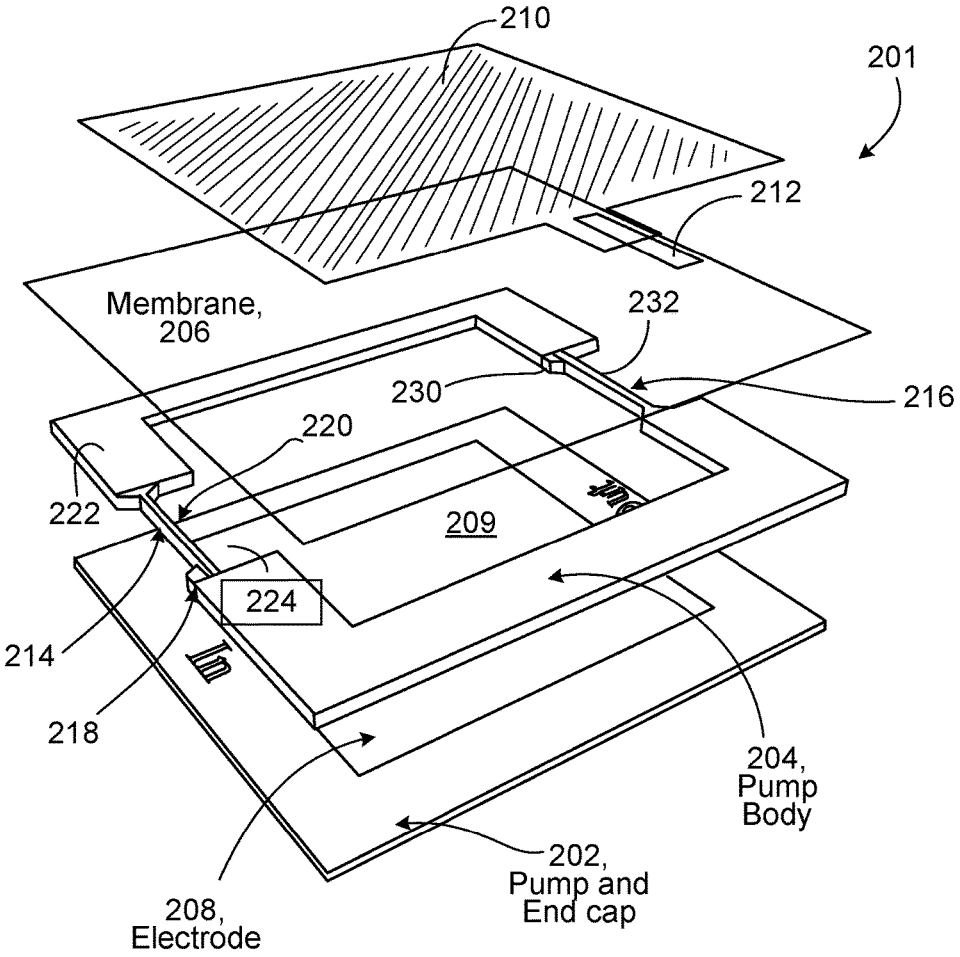
FIG. 2B is an exploded view of module layers.

Referring now to FIG. 2B, the module layers 201 each include a pump end cap 202 forming a fixed pump wall (similar to walls 106, 108 FIGS. 1A, 1B). An electrode 208 is attached to the pump end cap 202 for activating a compartment 209.

A single module layer 201 forms a portion of a pump body 204 between the pump end cap 202 with the electrode 208, and a membrane 206 along with an electrode 210 that is attached to the membrane 206 on the opposite side of the pump body 204 (similar as the membrane 116, 126 in FIGS. 1A, 1B). The electrode 210 includes a lead 212 to be connected to a drive circuit external to the module layer 200.

The membrane 206, the pump end cap 202, and the pump body 204 can have the same dimensions, and the electrodes 208, 210 can have smaller dimensions than the membrane 206 or the other elements. In some implementations, the membrane 206 has a dimension of about microns by microns to about millimeters by millimeters, and a thickness of about 5 microns. The pump body 204 has an outer dimension of about microns by microns to about millimeters by millimeters, a thickness of about 50 microns, and an inner dimension of about microns by microns to about millimeters by millimeters. The thickness of the pump body defines the nominal size of the compartment 209 (similar to compartments 130, 142 FIG. 1A). The electrodes 210, 202 have dimensions that substantially correspond to inner dimensions of the pump body 204. In some implementations, the electrodes have a surface area of about 2.25 $mm^2$ and a thickness of about 0.5 microns. An assembled module layer 201 is shown in FIG. 2C.

Figure 2C:
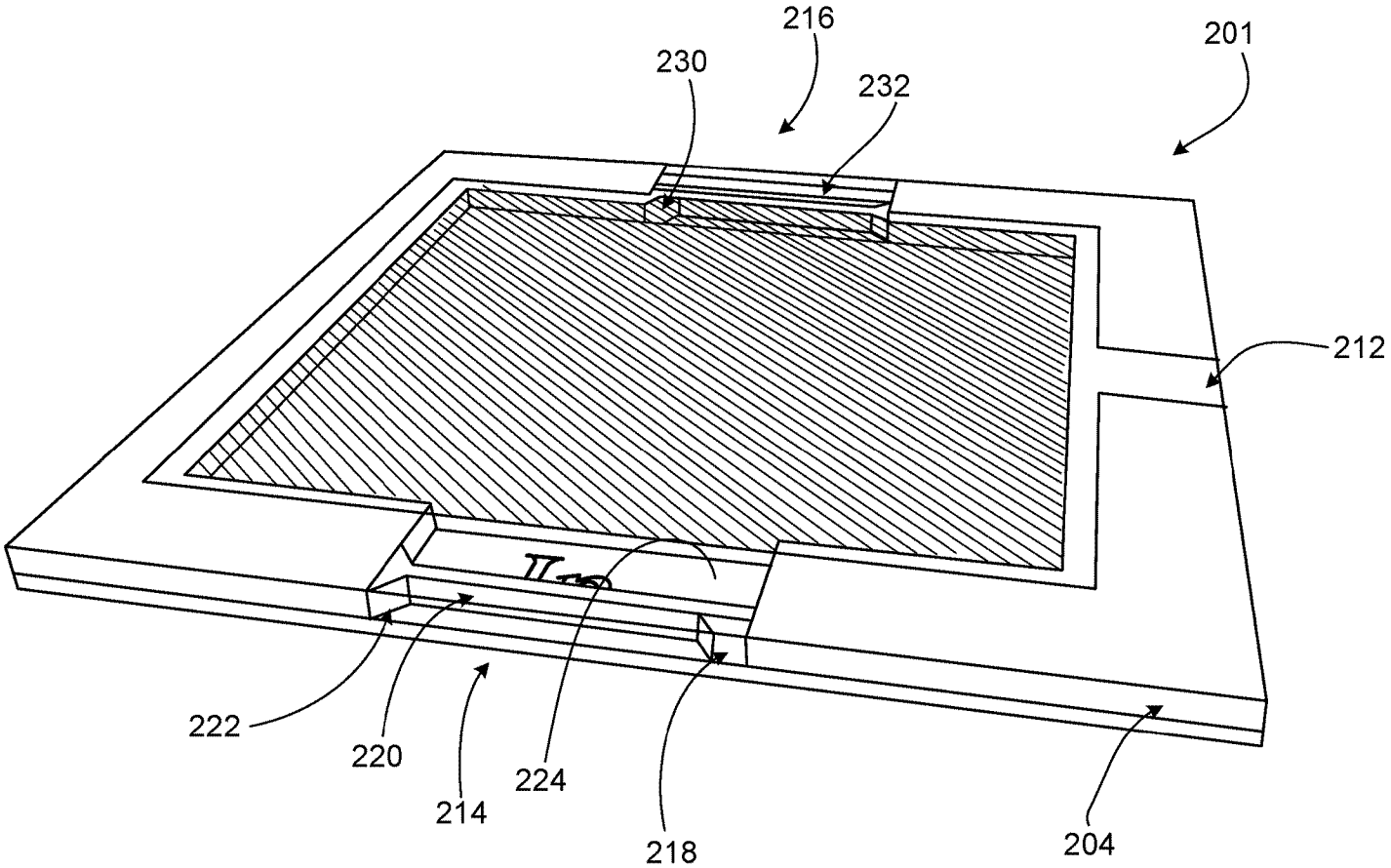
FIG. 2C is an assembled view of the module layer of FIG. 2B.

Referring now also to FIG. 2C, the pump body 204 includes two passive valves 214, 216, forming an inlet and an outlet, respectively. The inlet valve 214 includes a stopper 218 and a flap 220. The stopper is connected to the pump body 204 and is located external to the compartment 130, 140 formed by the pump body. The flap 220 has one end 222 attached to the pump body 204 and another end 224 movable relative to the stopper 218 and the pump body 204. In particular, the end 224 of the flap can bend towards the interior of the compartment 130, 140 when a pressure differential is established such that the pressure external to the module layer is larger than the pressure inside the module layer. For example, such a pressure differential is established during a charging operation in which a fluid flows from outside the module layer into the compartment 209. When the internal pressure is higher than the external pressure, e.g., during a discharge operation in which a fluid flows from the compartment 209 away to the outside of the module layer, the flap 224 bends towards the stopper and is stopped by the stopper 218. Accordingly, during the discharge operation, the fluid in the compartment 209 does not flow out from the inlet valve 214.

The outlet valve 216 also includes a stopper 230 and a flap 232 similar to the stopper 218 and the flap 220, respectively. However, the stopper 230 is located in front of the flap 232 along a direction in which the fluid flows into or out of the compartment 209. When the internal pressure is higher than the external pressure, the flap bends away from the stopper to open the valve and when the internal pressure is lower than the external pressure, the flap bends towards from the stopper to close the valve. Effectively, during the charging operation, the outlet valve 216 is closed so that the fluid does not flow out of the valve 216, and during the discharging operation, the outlet valve 216 is open and the fluid flows out from the valve 216.

Figure 2D:
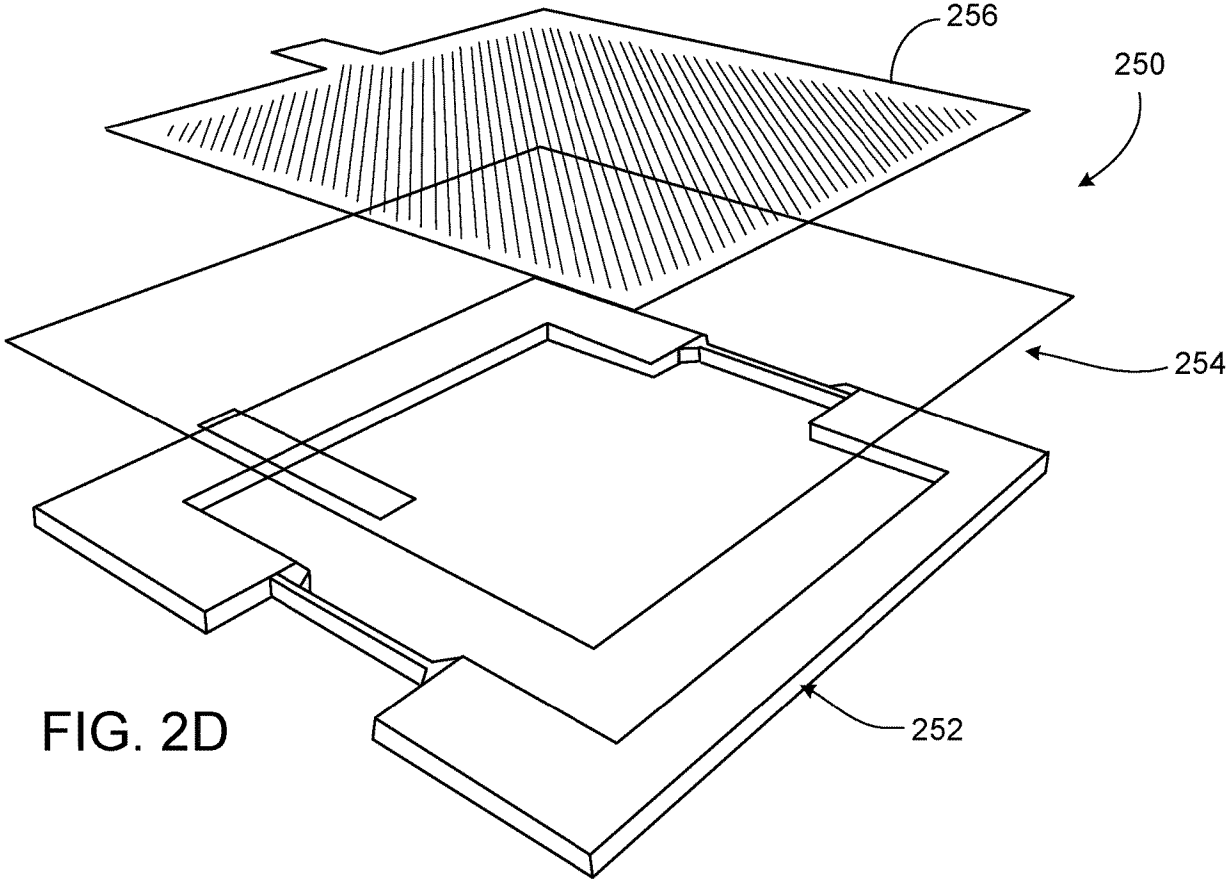
FIG. 2D is an exploded view of an intermediate module layer.

Referring to FIG. 2D, intermediate compartments (similar to compartments 132-140 FIGS. 1A-B) can each be formed using a module layer 250. The module layer 250 includes a pump body 252, an electrode 256, and a membrane 254 formed between the electrode 256 and the pump body 252. The pump body 252 can have similar or the same features as the pump body 204, the electrode 256 can have similar or the same features as the electrode 208, and the membrane 254 can have similar or the same features as the membrane 206. The module layer 250 also includes flap valves (not referenced but shown in the figure.)

As described previously, the valves of each pump body can be formed integrally with the pump body. Although the electrodes are shown as a pre-prepared sheet to be attached to the other elements, the electrodes can be formed directly onto those elements, e.g., by printing. The different elements of the module layers 200, 250 can be bonded to each other using an adhesive. In some implementations, a solvent can be used to partially melt the different elements and adhere them together.

Referring back to FIG. 2A, thus multiple, e.g., two, three, or any desired number of, module layers 250 of FIG. 2D are stacked on top of each other to form multiple intermediate compartments in a pump chamber. In the stack 200, each membrane is separated by a pump body and each pump body is separated by a membrane. To form a complete pump, a module layer 201 of FIG. 2B is placed on each of the top and bottom ends of the stack 200 so that the pump end caps of the module layer 201 form two fixed end walls of the pump chamber.

Referring again to FIGS. 1A and 1B, during each pumping cycle, the compartments are activated such that each compartment charges during half of the cycle and discharges during the other half of the cycle. Adjacent compartments operate in 180 degree phase difference, i.e., when the compartment 130 is charging, its adjacent compartment 132 is discharging, and vice versa. As a result, every other compartment operates in phase. In FIGS. 1A and 1B, the compartments are labeled by odd-numbered ("O") compartments and even-numbered ("E") compartments, the O compartments are in phase with each other, the E compartments are in phase with each other, and the O compartments are out of phase relative to the E compartments.

To operate compartments of the pump in their discharging state, voltages of opposite signs are applied to the electrodes on opposing walls of these compartments. For example, as shown in FIG. 1A, the voltage of the electrode on the fixed wall 106 is negative while the voltage of the electrode on the membrane 116 is positive, or the voltage of the electrode on the membrane 118 is positive while the voltage of the electrode on the membrane 120 is negative, etc. Simultaneously, the other compartments of the pump are operated in their charging state. Voltages of the same signs are applied to the electrodes on opposing walls of these other compartments. The voltages of opposite signs cause the two opposing walls of the compartments to attract each other and the voltages of the same signs cause the two opposing walls of the compartments to repel each other. The fixed walls 106, 108 do not move. However, the membranes 116-126 move towards a direction of the attraction force or a direction of the repelling force. As a result, in half of a pumping cycle, the compartments 130, 134, 138, 142 discharge and the other compartments simultaneously charge (FIG. 1A), and in the other half of the pumping cycle, the compartments 132, 136, 140 discharge and the other compartments simultaneously charge (FIG. 1B).

In some implementations, the material of the membranes and the voltages to be applied to the membranes and the end walls 106, 108 are chosen such that when activated, each membrane expands substantially half the distance d between the nominal positions of adjacent membranes. In the end compartments 130, 142 where the distance between the nominal position of the membrane and the fixed wall is d/2, the activated membrane reduces the volume of the compartment to close to zero (in a discharging operation) and expands the volume of the compartment to close to $2*V_e$. For the intermediate compartments, by moving each membrane by d/2, a volume of a compartment is expanded to close to $2*V_i$ in a charging operation and reduced to close to zero in a discharging operation. The micro pump 100 can operate at a high efficiency.

The period of the pumping cycle can be determined based on the frequency of the drive voltage signals. In some implementations, the frequency of the drive voltage signal is about Hz to about KHz, e.g., about 2 KHz. A flow rate or pressure generated by the pumping of the micro pump 100 can be affected by the volume of each compartment, the amount of displacement the membranes make upon activation, and the pumping cycle period. Various flow rates, including high flow rates, e.g., in the order of ml/s, and pressure, including high pressure, e.g., in the order of tenths of one psi, can be achieved by selecting the different parameters, e.g., the magnitude of the drive voltage. As an example, a micro pump can include a total of 15 module layers, including two layers 200 of FIG. 2B and 13 layers 250 of FIG. 2C. This example micro pump can be drive at a frequency of about 843 Hz and consumes power of about 0.62 mW, and provides a flow rate of about 1.56 ml/s at about 0.0652 psi.

In some implementations, four types of electrical signals are used to drive the membranes. The four types are:

V−: a DC reference for all the voltages; may be used to drive some membranes directly;

V+: a DC high voltage used to drive some membranes directly and switched for others;

V1: a periodic AC waveform used to drive some membranes to control operation. It includes a 50% duty cycle and swings between V− and V+ in one full pumping cycle.

V2: identical to V1 except it is 180 degrees out of phase.

Furthermore, based on the phenomenon of pull-in and drop-out voltages, the drive voltage can be reduced to a lower voltage once the highest magnitude of V1 or V2 has been reached. In particular:

V1.5: the pull-in voltage value.

V2.5: the drop-out voltage value.

Figure 3:
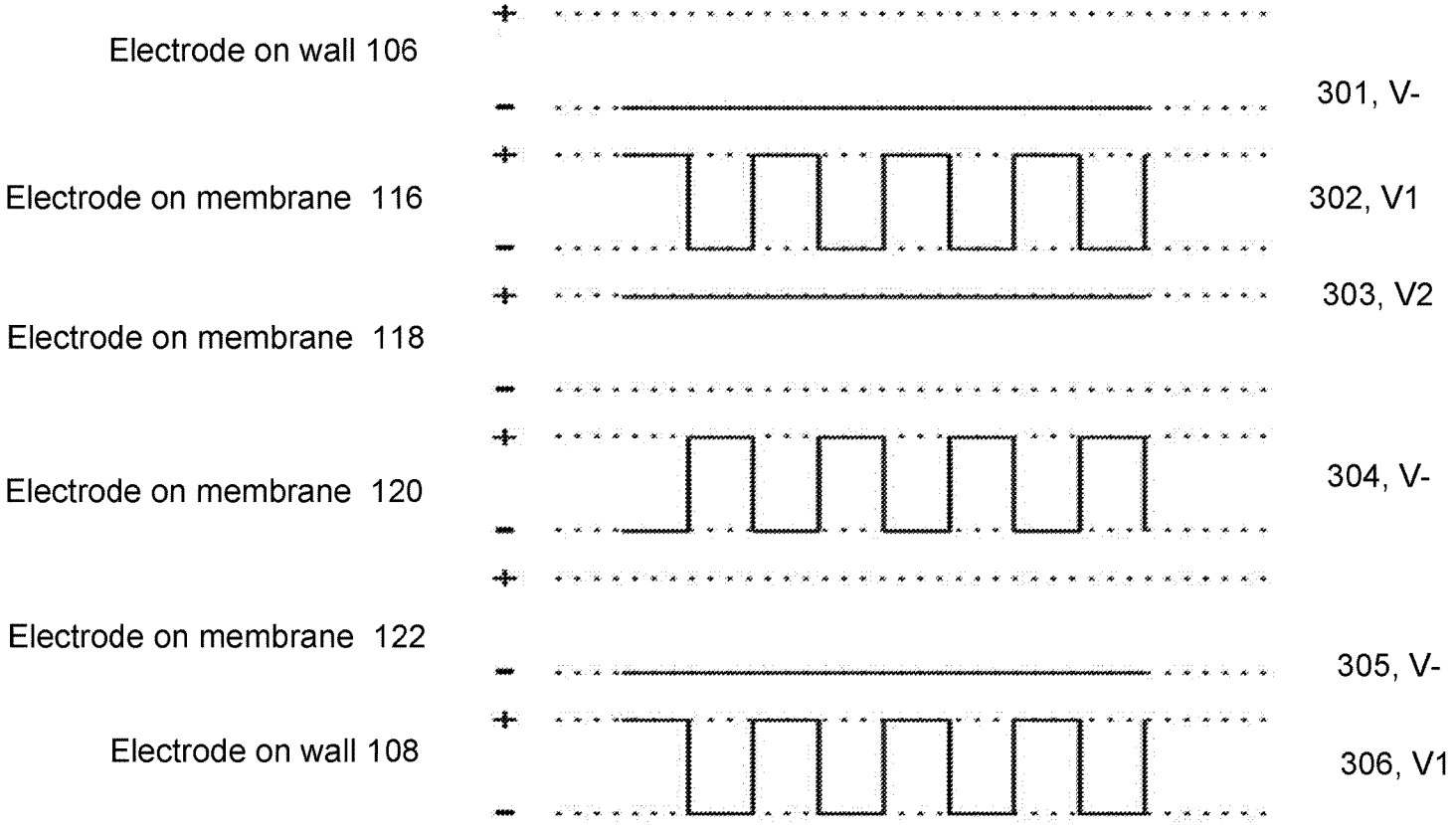
FIGS. 3 and 4 are plots of voltage waveforms for application to electrodes of a micro pump.

Referring now to FIG. 3, six example sets of waveforms 301-306 for application onto six electrodes on the fixed wall 106 and the membranes 116-124, respectively are shown. The waveforms applied to other additional membranes and fixed wall in the micro pump 100 or other micro pumps can be derived by the pattern shown in FIG. 3. During pumping cycles, V− of the first set of waveform 301 is constantly applied to the electrode on the fixed wall 106. The second set of waveform 302 for applying to the membrane 116 is in the form of V1. The third set of waveform 303 is V+ and is constantly applied to the membrane 118. The fourth set of waveform 304 is V2 for applying to the membrane 120. The fifth set of waveform 305 and sixth set of waveform 306 are a repeat of the first and second waveforms 301, 302. If additional waveforms are needed for other membranes, e.g., membranes 124 and 126 (FIG. 1A) the repetition continues with the third and fourth waveforms, and etc.

In some implementations, the magnitudes of V1, V2, V−, and V+ are the same. In other implementations, magnitudes of at least some of these voltages are different. Although a particular pattern of waveforms are shown, the electrodes of the pump 100 can also be activated by other patterns of waveforms.

Figure 4:
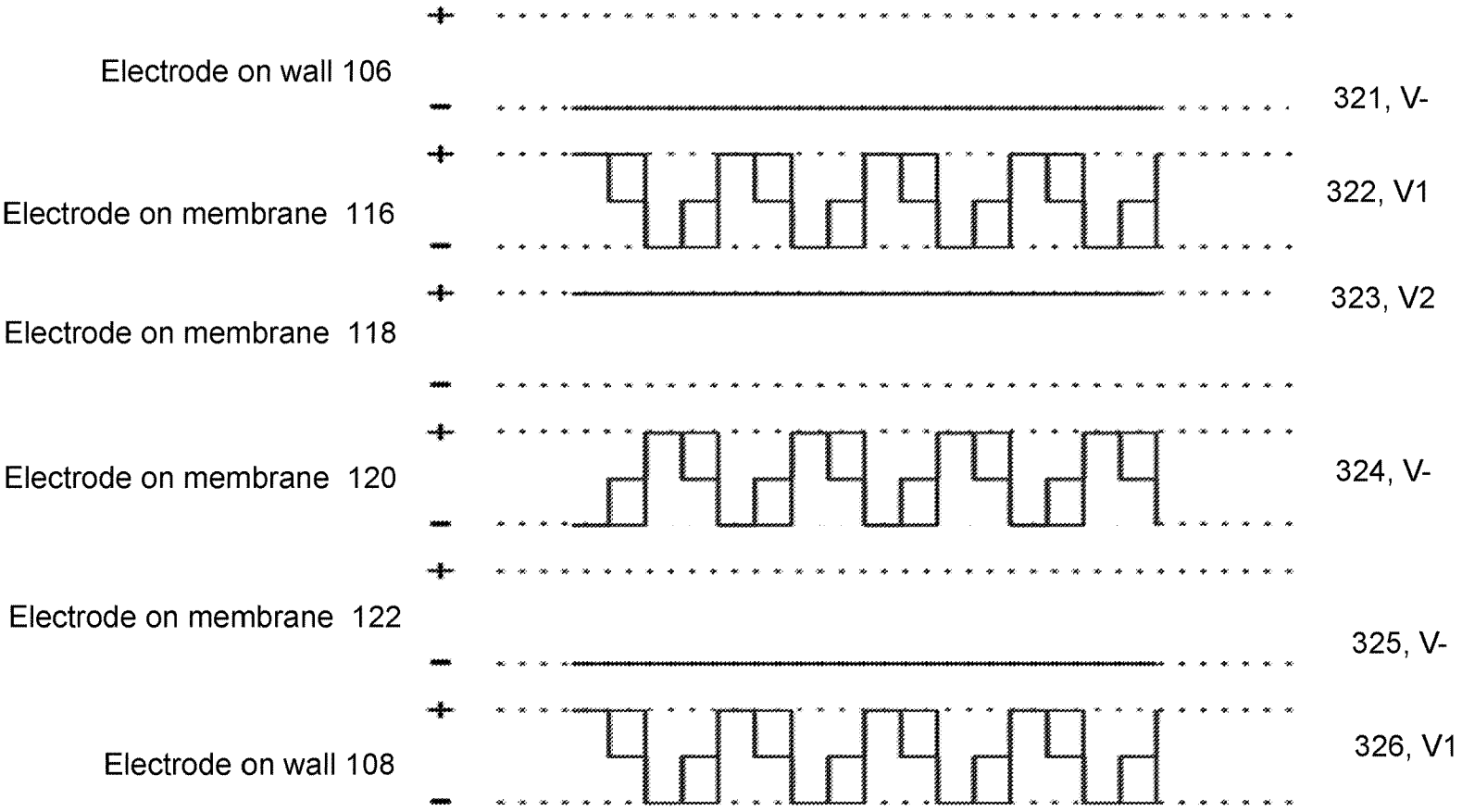

Referring now to FIG. 4, six sets of waveforms 321-326 corresponding to the six sets of waveforms 301-306 of FIG. 3, respectively are shown. The difference between the sets shown in FIG. 4 and the sets shown in FIG. 3 is that the AC voltage waveforms V1 and V2 of FIG. 3 are reshaped into V1.5 and V2.5, respectively to take the advantage of pull-in and drop-out phenomena.

In this example, in the waveform sets 322, 324, 326, the positive going voltage is stepped down (shown by arrows ↓) to a lower voltage once the pull-in point has been reached. This lower voltage is still greater than the drop-out voltage so that the membranes remain in their driven state. The next voltage transition defines the beginning of the opposite operation, during which a similar voltage level shift is applied. The negative going voltage is stepped up (shown by arrows 1) to a voltage having a smaller magnitude. The power consumption of the pump 100 can be reduced by reducing the magnitude of the drive voltages during their hold time.

Drive Circuitry

Figure 5:
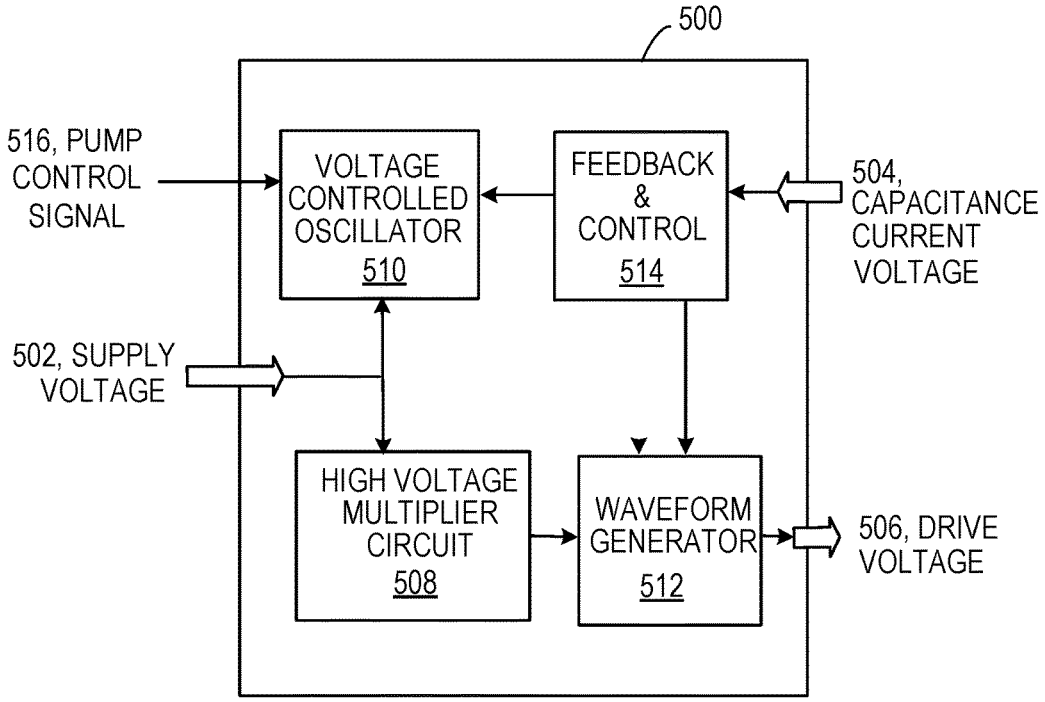
FIG. 5 is a block diagram of an exemplary drive circuit.

Referring now to FIG. 5, an example of drive circuitry 500 for applying voltages, such as those shown in FIG. 3 or FIG. 4 is shown. The drive circuitry 500 receives a supply voltage 502, a capacitance voltage current 504 signal, and pump control 516, and outputs drive voltages 506 to electrodes of a micro pump, such as the micro pump of FIGS. 1A and 1B. In some implementations, the supply voltage 502 is provided from a system in which the micro pump 100 is used. The supply voltage can also be provided by an isolation circuit (not shown).

The drive circuitry 500 includes a high voltage multiplier circuit 508, a voltage controlled oscillator ("VCO") 510, a waveform generator circuit 512, and a feedback and control circuit 514. The high voltage multiplier circuit 508 multiplies the supply voltage 502 up to a desired high voltage value, e.g., about 100V to 700V, nominally, 500 V. Other voltages depending on material characteristics, such as dielectric constants, thicknesses, mechanical modulus characteristics, electrode spacing, etc. can be used. In some implementations, the high voltage multiplier circuit 508 includes a voltage step-up circuit (not shown). The voltage controlled oscillator 510 produces a drive frequency for the micro pumps. The oscillator 510 is voltage controlled and the frequency can be changed by an external pump control signal 516 so that the pump 100 pushes more or less fluid based on flow rate requirements. The waveform generator circuit 512 generates the drive voltages for the electrodes. As described previously, some of the drive voltages are AC voltages with a specific phase relationship to each other. The waveform generator circuit 512 controls these phases as well as the shape of the waveforms. The feedback and control circuit 514 receives signals that provide measures of capacitance, voltage and or current in the micro pump and the circuit 514 can produce a feedback signal to provide additional control of the waveform generator 512 of the circuit 500 to help adjust the drive voltages for desired performance.

Integration of the Systems in Devices

The micro pump systems described above can be integrated in different products or devices to perform different functions. For example, the micro pump systems can replace a fan or a blower in a device, e.g., a computer or a refrigerator, as air movers to move air. Compared to the conventional fans or blowers, the micro pumps may be able to perform better at a lower cost with a higher reliability. In some implementations, these air movers are directly built into a host at a fundamental level in a massively parallel configuration.

In some implementations, the micro pump systems receive power from a host product into which the systems are integrated. The power can be received in the form of a single, relatively low voltage, e.g., as low as 5V or lower, to a drive circuitry of the micro pump systems, e.g., the drive circuitry 500 of FIG. 5.

System Configuration

The module layer stack of FIGS. 1A, 1B, and 2D can be viewed as module layers connected in parallel. The volume of each individual module layer, $V_i$ or $V_e$, is small. In some implementations, even the total volume of all layers in the stack is relatively small. In some implementations, multiple stacks or micro pumps can be connected in parallel to increase the total volume flow rate.

Similarly, the pressure capability of an individual micro pump is relatively low. Even though there are multiple module layers in a stack, the layers do not increase the total pressure of the stack because they are connected in parallel. However, the pressure of the stack can be increased when multiple stacks or micro pumps are connected in series. In some implementations, the pumps connected in series are driven at different speeds to compensate for different mass flow rates. For example, built-in plenums or plumbing in a tree type configuration can also be used to compensate for different mass flow rates.

Figure 6:
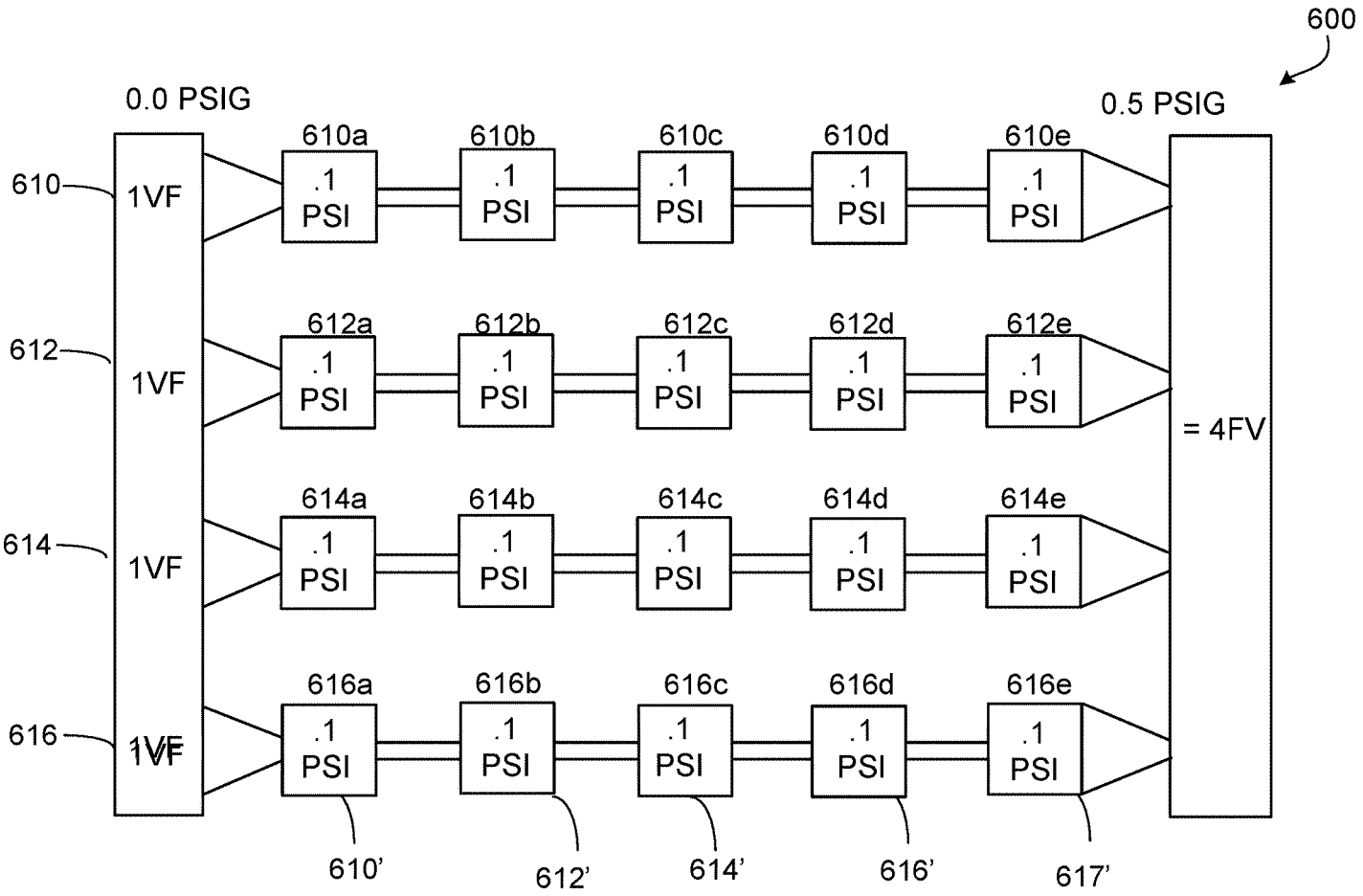
FIG. 6 is a block diagram of micro pumps arranged in an exemplary grid configuration.

Referring now to FIG. 6, rows 610-616 and columns 610'-616' and column 617' of module layer stacks (which can also be called micro pump stacks) 610*a*-610*e*, 612*a*-612*e*, 614*a*-614*e*, and 616*a*-616*e* are shown connected in a grid configuration 600. The module layer stacks in each row 610, 612, 614, 616 are connected in series. The rows 610-616 of module layer stacks 610*a*-610*e*, 612*a*-612*e*, 614*a*-614*e*, and 616*a*-616*e* are connected in parallel via a common input 620 and a common output 622.

Effectively, the serially connected stacks in each row can provide a total pressure substantially equal the sum of the individual stack pressures. In the example shown in the figure, if each stack has a pressure of 0.1 psi and each row includes five stacks, then a total pressure of 0.5 psi is effected by each row, and which is also the total pressure of the grid 600. The grid 600 has a total flow rate that is four times the flow rate of each row of stacks.

In the example shown in the figure, each row of stack has a flow rate of 1 volume flow (vF). The grid includes four parallel-connected rows, leading to a total flow rate of 4 vF. To achieve a desired pressure and a desired flow rate, a grid similar to the grid 600 can be constructed by choosing the number of stacks to be serially connected and the number of rows to be connected in parallel.

Alternatively, another series configuration has a common plenum disposed between each stage of a grouping of parallel pumps. This configuration would tend to equalize discharge pressures and thus input pressure at the next stage. In some implementations, the stacks are relatively small and many of them can be fabricated in a small area. The plumbing and wiring of the grid can be done at the time of fabrication of the individual stacks and can be done in a cost effective manner.

Example Applications

As described above, air can be used for an electrochemical reaction and cooling, e.g., in fuel cells. Generally, the amount of air used for cooling is many times more than for the reaction.

Figure 7:
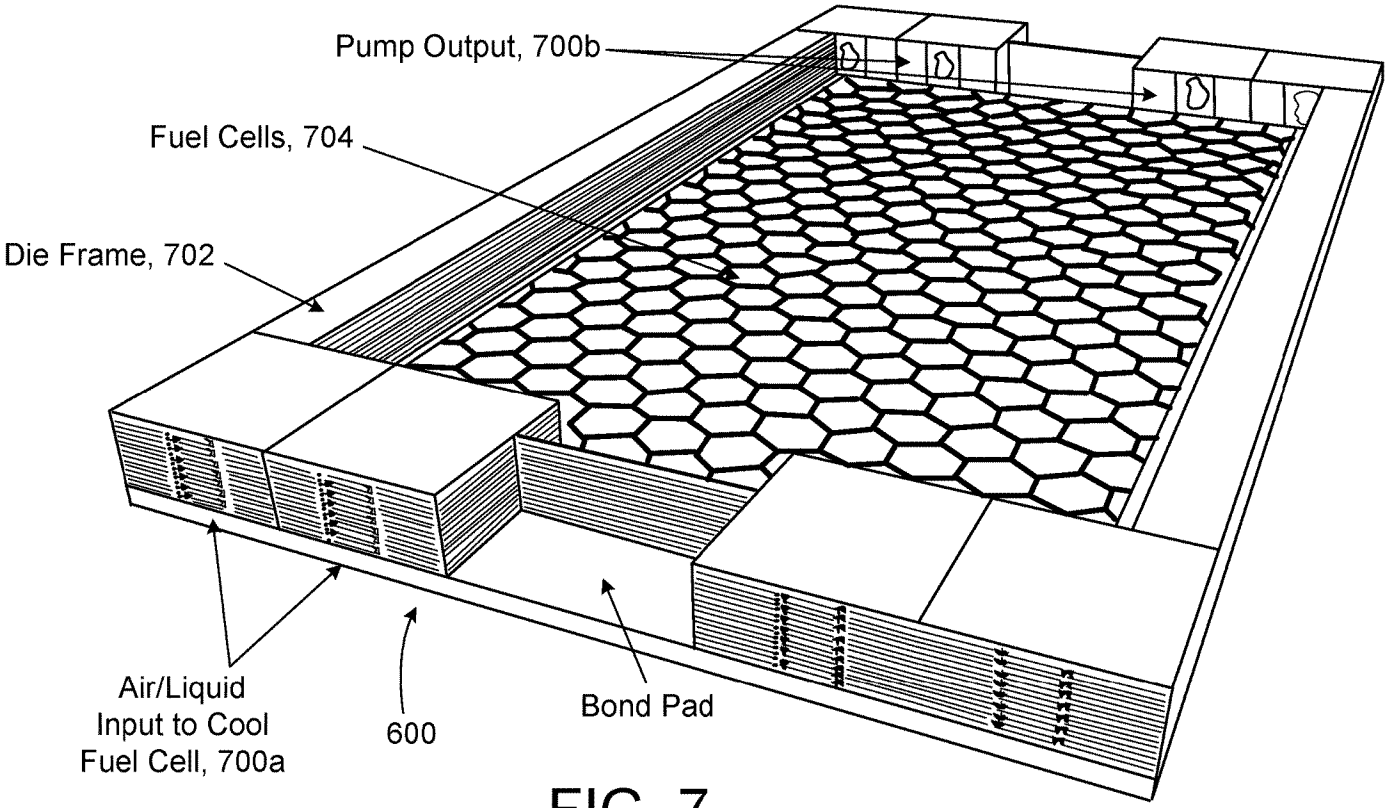
FIG. 7 is a perspective view of micro pumps integrated in a die frame.

Referring to FIG. 7, a fuel cell with an integrated micro pump system 700 with fluid inputs 700*a* and outputs 700*b* is shown. The micro pump system 600 (or 100 or 200) having features described above are integrated directly into a die frame 702 that contains fuel cells 704. When multiple dies frames are used, generally, there is a minimum spacing among the dies and some of this space can be used to house the micro pump systems 600 with no additional volumetric overhead to the dies. An exemplary fuel cell is disclosed in U.S. application Ser. No. 10/985,736, filed Nov. 9, 2004, now U.S. Pat. No. 7,029,779, and entitled "Fuel cell and power chip technology," the contents of which are incorporated herein by reference in their entirety.

Integrating the air pump systems can effectively divided the air moving function into many, e.g., thousands of parts, minimizing the need for blowers or fans to move the air. The micro pumps can be mass manufactural at a low cost, have small sizes and light weight, be reasonably powerful and consumes low power, allowing for the massive distribution of air movement. The micro pump systems 600 can be used any time air (or liquid) needs to be moved in a tight space.

Another such application is the cooling of electronic components like the CPU.

Figure 8A:
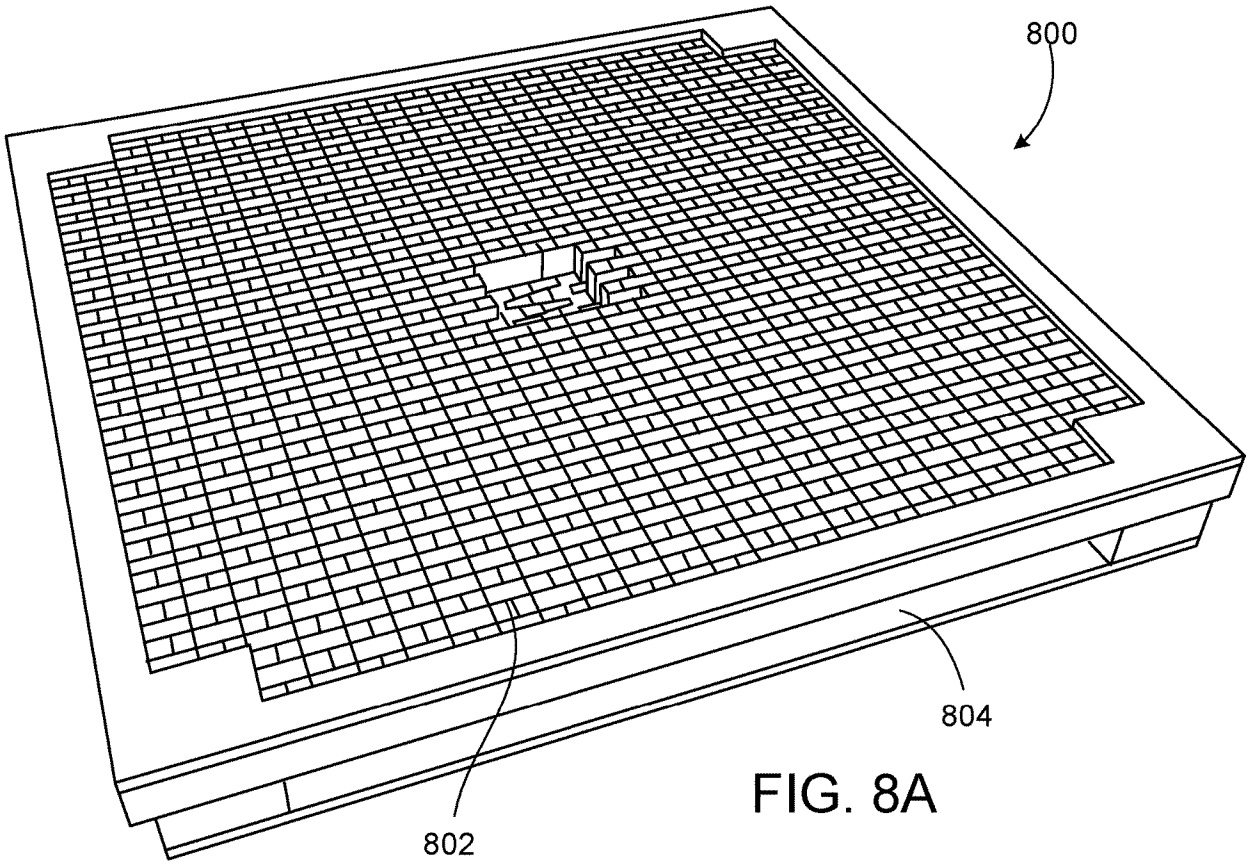
FIGS. 8A and 8B are respective top side view and bottom side view of an exemplary cooling device in a cooling arrangement.
Figure 8B:
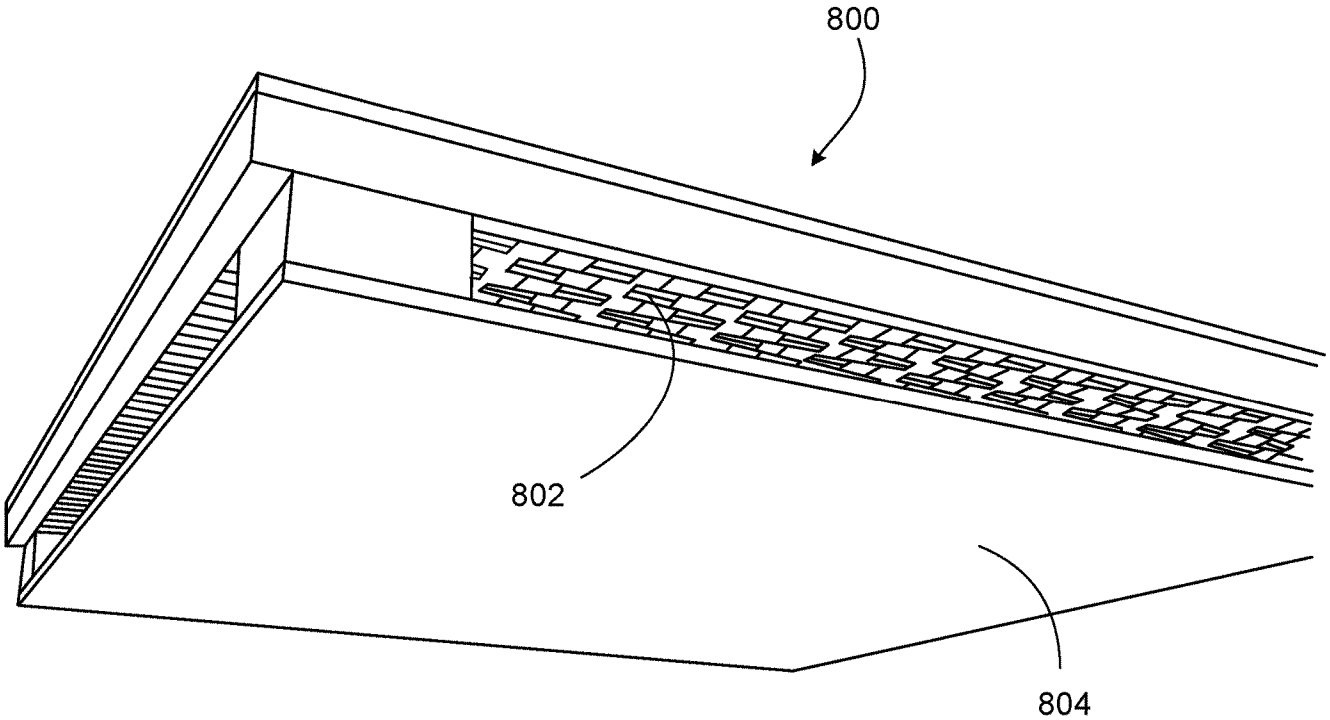

Referring now to FIGS. 8A and 8B, the micro pump (100, 200, 600) is used to cool circuits/devices, (e.g., central processor units, etc.) that run at very high temperatures, as well as, e.g., solar cells and LED lighting.

As an example, FIGS. 8A and 8B show the top side view and bottom side view of a CPU cooler 800. Instead of a large heat sink and fan arrangement, one or more layers of micro pumps 802 point directly at a cooling plate 804, for an impingement effect, that is affixed to the CPU. In some implementations, the CPU cooler 800 can remove 150 watts of heat. The cooler has a low profile and can be used in computer designs that have little available space.

The micro pump systems can be used to pump a liquid through a cooling plate fastened to the CPU to remove and transfer heat, by the liquid, to a distant location. For example, the hot liquid carrying the heat can be pumped through a radiator and additional micro pumps can be used to blow air to cool the radiator.

The micro pump systems can also blow air across a heat sink used in a traditional approach; or can be built into the heat sink. As described previously, the micro pump systems can be configured to provide an increased pressure to push air further. The micro pump systems can also be distributed throughout a host device without needing air ducts.

Figure 9A:
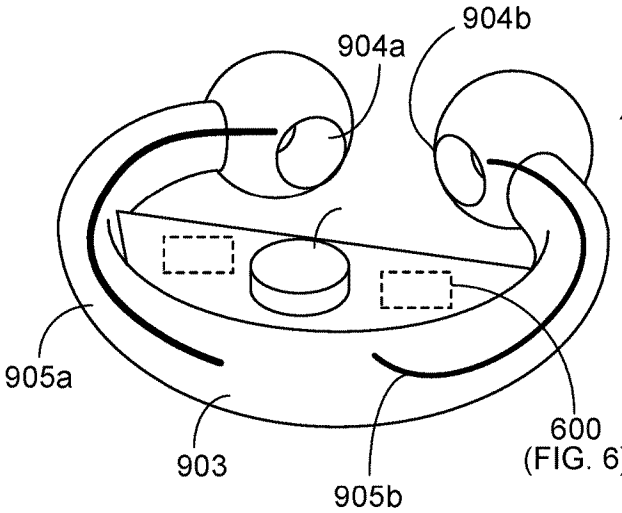
FIGS. 9A-9C are respective perspective, front, and solid views of an airway pressure breathing device.
Figure 9B:
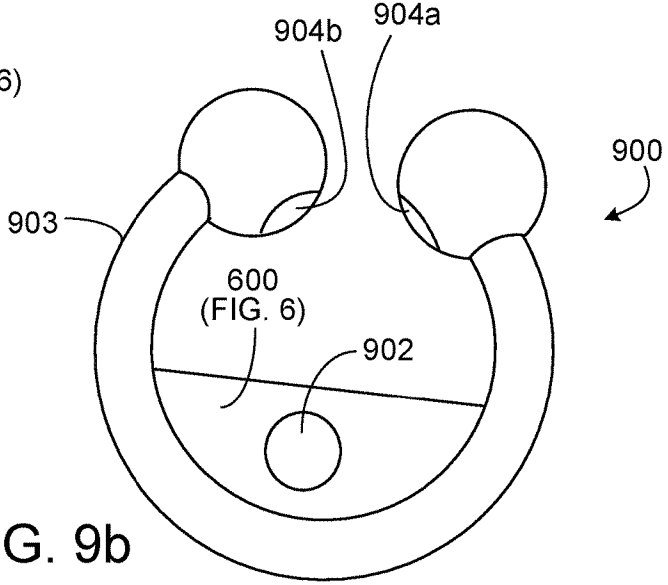

Referring now to FIGS. 9A and 9B, an autonomous device for treating breathing disorders 900 (device) is shown. The device 900 is a CPAP type (continuous positive airway pressure) breathing device. However, the device 900, unlike CPAP machines, is an autonomous device that is local to the nose and which provides a required amount of air flow at a required pressure to treat various breathing disorders such as obstructive sleep apnea ("OSA").

The CPAP breathing device 900 is shown in the form of a nose ring. Other arrangements are possible (see FIG. 9D). The device 900 has passages 902 for air inlets and micro pumps 600 (FIG. 6) disposed in the body 904 of the device 900, as shown. The device may also contain valves (See FIGS. 10 AND 10A-10F) to provide for exhalation. The ends 904*a*, 904*b* of the device 900, which fit into the nose of a user, provide airflow via passages 905*a*, 905*b*, and sealing and are connected via a ring portion 903 within which can be disposed a power source, e.g., battery (not shown).

As the micro pump systems are small and can move a significant amount of air, the micro pump system is built into the device 900, e.g., to provide relief to many people who have sleep apnea or obstructive breathing disorder (OBD). The device 900 can be a self-contained device that has a small size (e.g., fitting under the nose) and a light weight (e.g., as light as a few grams), and can be operated using batteries.

In some implementations, the device 900 can include exhalation valves (discussed below) whereas in other implementations the exhalation valves may be omitted.

In some implementations, the device 900 can be rechargeable, e.g., the batteries can be recharged. In others the device can be disposable. A user can wear the device at night and throw it away each day. Alternative arrangements are possible such as the use of air-metal batteries in the devices. The air-metal batteries, (e.g., air-zinc) are activated and last for a period of time, and which thereafter are disposed of.

Device 900 is configured to fit into a user's nose and supplies pressurized air flow from the micro pump 600 (or 100, 200) built into the ring. The device 900 thus does not require hoses or wires to another device (e.g., a machine) and the device uses a self-contained power source, e.g., a battery that is configured to operate for about a full-night's sleep, e.g., about eight hours or so. The device 900 does not need straps. The device can be configured to stop blowing air into a user's nose when a user is exhaling or when a user is in a pause state just prior to inhaling. The device 900 has an exhalation valve that eliminates exhalation resistance (fighting against oncoming air or cutting off the end of exhalation prematurely).

The device 900 can sense pressure to turn on and off the micro air pumps. The device 900 senses pressure on every breath and at different points in the breathing cycle to configure operation of the micro air pumps to close the exhalation valve at the "end" of the exhalation cycle. This device responds to the user on a breath by breath basis.

The device 900 is small, light-weight and fits under a use's nose, making a seal in the user's nose to hold the device in place. The device can provide proper pressure for apnea treatment during a pause period and proper hypopnea pressure range during an inhalation period. The device 900 can be disposable, thus would not require cleaning, can be low cost. Moreover, due to its relative comfort compared to existing CPAP machines, the device 900 promotes compliance as the device is comfortable, require no straps, masks or tethers.

Figure 9C:
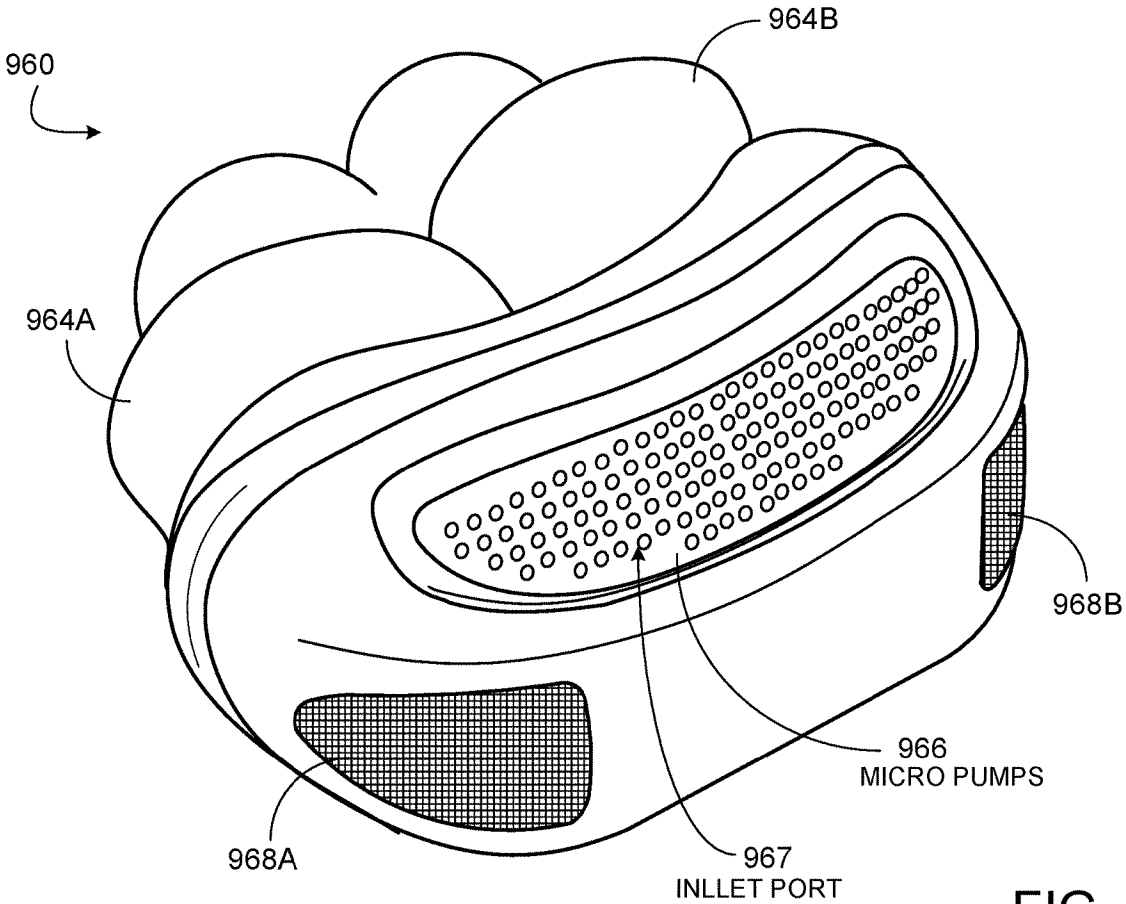

Referring now to FIG. 9C, a conceptual view of an alternative configuration for a CPAP device 960 is shown. In this configuration, the CPAP device 960 includes a body 962 that houses a micro pumps 600 here having 57 component-pump elements denoted as 966, and an exhalation valve (see FIGS. 10A-10F). The CPAP device 960 has cushioned plugs 964*a*, 964*b* with air passages through the plugs that provide a nasal interface. The cushioned plugs are made of a generally rubbery material that make a tight fit when inserted into a user's nostrils. The CPAP device 960 has one or as shown two outlets 968*a*, 968*b* for exhilaration of air.

Figure 10:
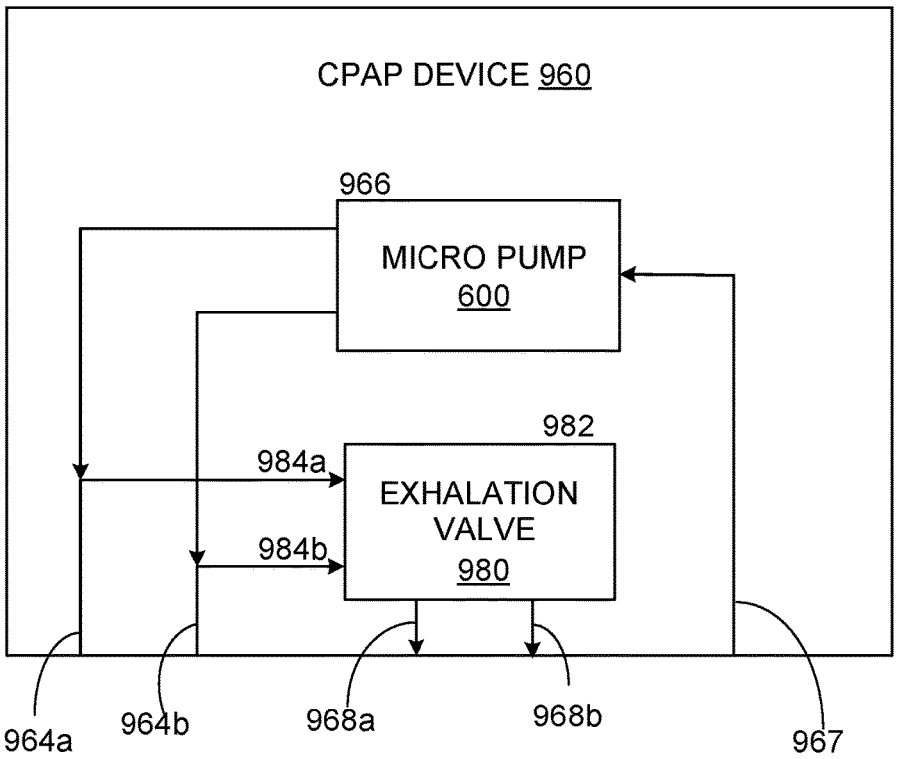
FIG. 10 is a block diagram of a CPAP device.
Figure 10B:
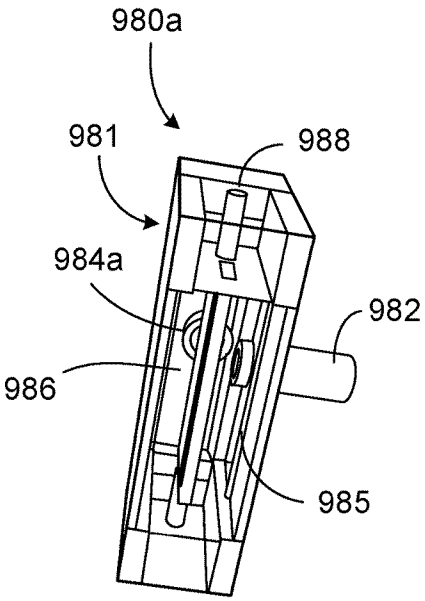
FIGS. 10A-10F are views of an exhalation valve.
Figure 10A:
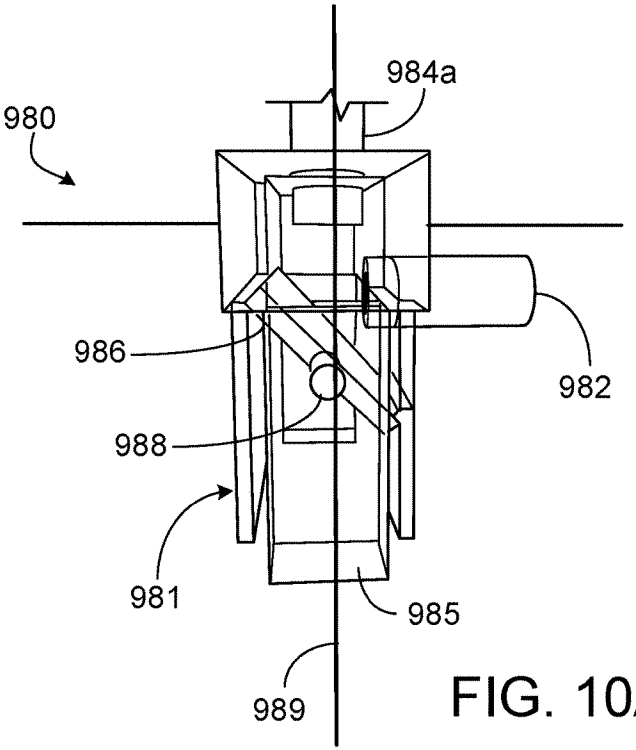
Figure 10D:
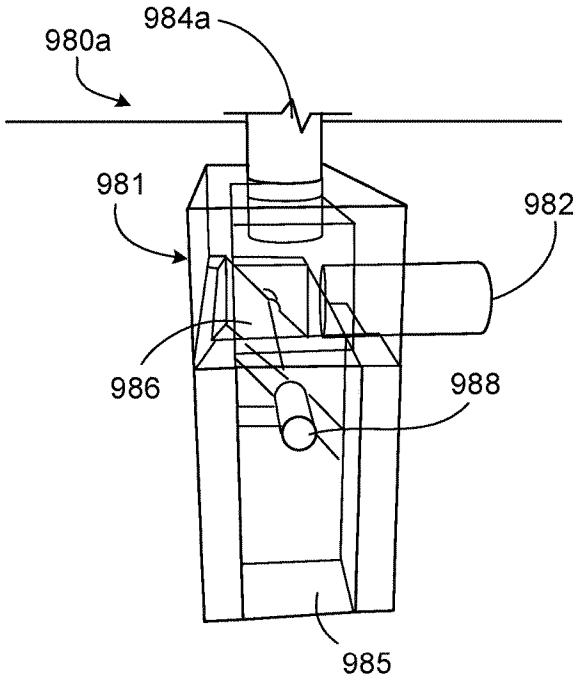
Figure 10C:
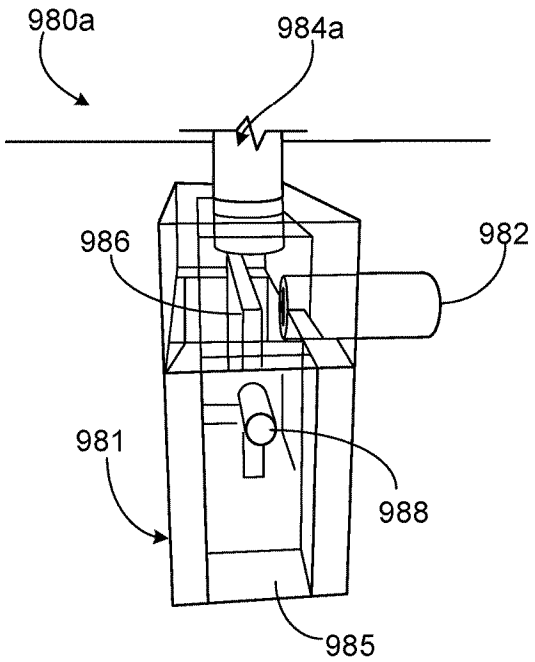
Figure 10E:
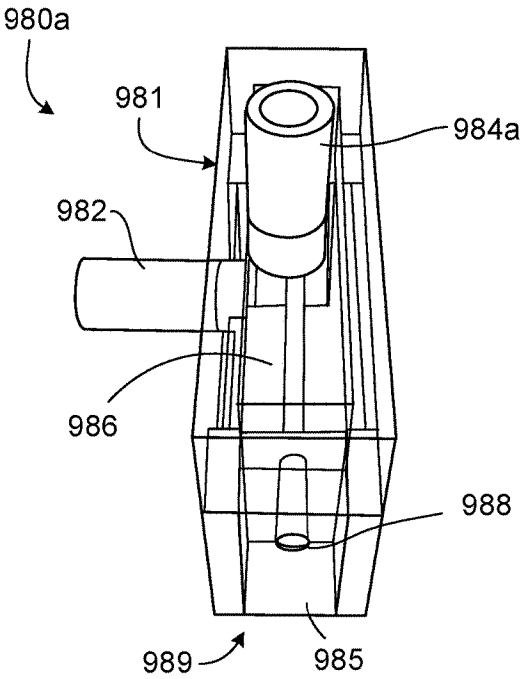
Figure 10F:
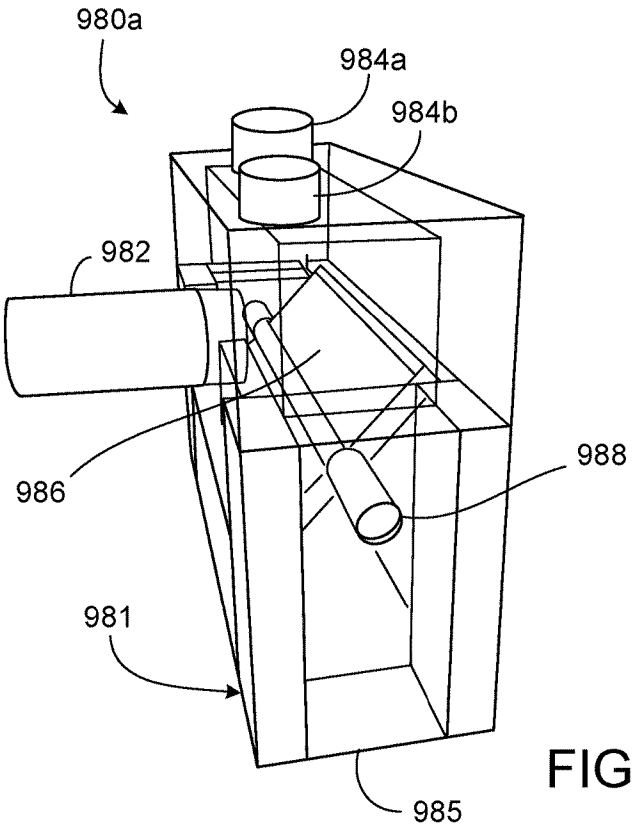

Referring now to FIG. 10, a schematic, e.g., of the configurations shown in FIGS. 9A-9C, an exhalation valve 980 coupled to a micro pump 600 within the CPAP device 900 or 960 (pumps 966). The exhalation valve 980 is coupled between the micro pumps 600 (100 or 200 as well) and inlets 964*a*, 964*b* and outlets 968*a*, 968*b* of the device 900, as shown. The exhalation valve 980 is of a butterfly configuration and uses air flow from the micro pumps to close the valves 980 at the end of an exhalation/beginning of pause in breathing and at the beginning of exhalation, the exhalation valve 980 opens even as the micro pumps blows air on the exhalation valves 980.

The device 900 is configured to select how much of the micro pumps' 600 air flow is needed to push the valve 980 shut. Pressure from the micro pumps 600 will hold the exhalation valve 980 shut prior to exhilaration. All of the exhalation air flow from the user is applied to the exhalation valve 980 to open the exhalation valves 980. The shape of valves' flaps may be optimized to assist the exhalation valve 980 to stay open during exhalation. In addition, weak magnetics may also be used to keep exhalation valve 980 open or closed depending on details of a design. The exhalation air from a user would generally be sufficient to overcome a minimum amount of air flow from the micro pump to keep the exhalation valves 980 closed.

Referring now to FIGS. 10A-10F, various views of a conceptual exhalation valve 980 are shown. FIGS. 10A-10F show a butterfly valve configuration that is used for the exhalation valve 980. Valve 980 is illustrated and includes a body 981, an inlet 982, ports 984*a* and 984*b* (984*b* shown only in the view of FIG. 10F), outlet ports 985 and a valve flap 986. The flap valve 986 is rotatable about an axial member 988 to open and close a passageway between the ports 984*a*, 984*b* and outlet port 985, denoted by the large arrow 989. The micro pump 600 applies air through inlet 982 to close the flap valve 986. In the context of FIG. 10 and FIG. 9C, the inlet 982 is coupled to an output of the micro pump, the ports 984*a*, 984*b* are coupled to the plugs 964*a*, 964*b* (with air passages) and the outlet is coupled to one or both of the outlets 968*a*, 968*b*.

The valves can be of various configurations. For example, as discussed in my pending patent application Ser. No. 14/632,423 filed Feb. 26, 2015 and incorporated herein by reference a sliding valve (a "T valve") can be used on output ports and a sliding valve (an "omega valve") can be used on input ports to the chambers of the micro pump, e.g., 200 (FIG. 2B). Recalling that the chamber 209 is produced from the pump body 204 and membranes 206 (FIG. 2B) (or end walls of the pump body).

Figure 11A:
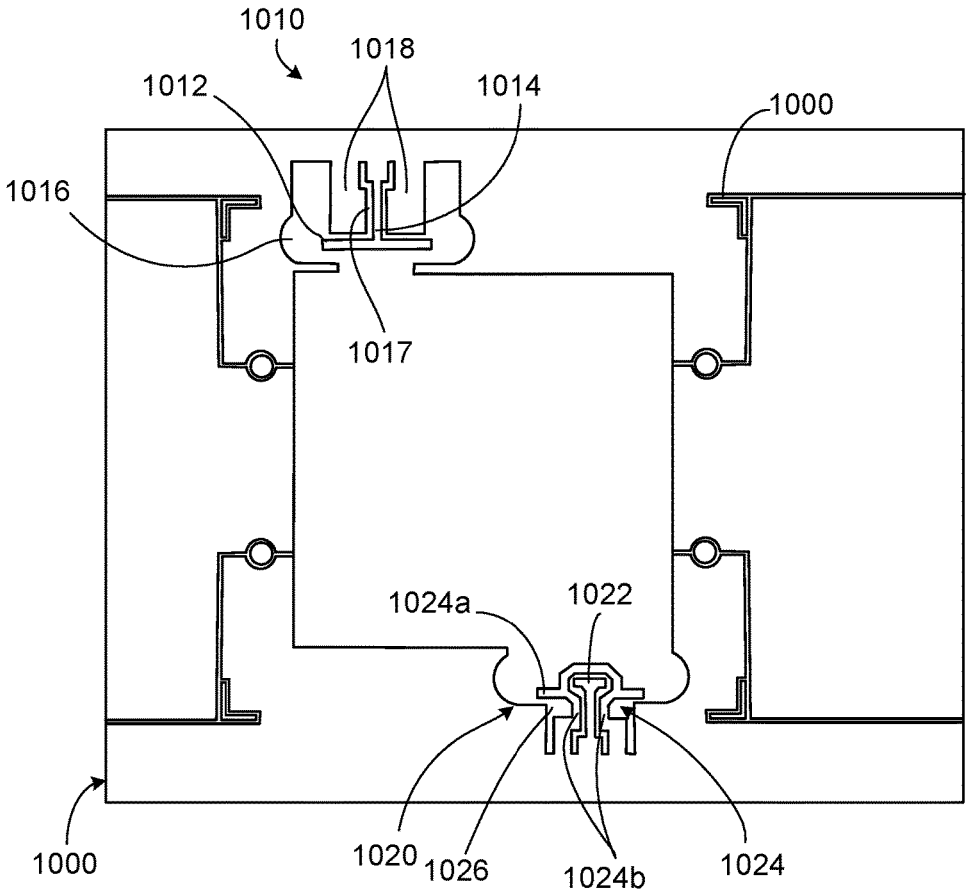
FIGS. 11A-11D show details of exemplary sliding valves.
Figure 11B:
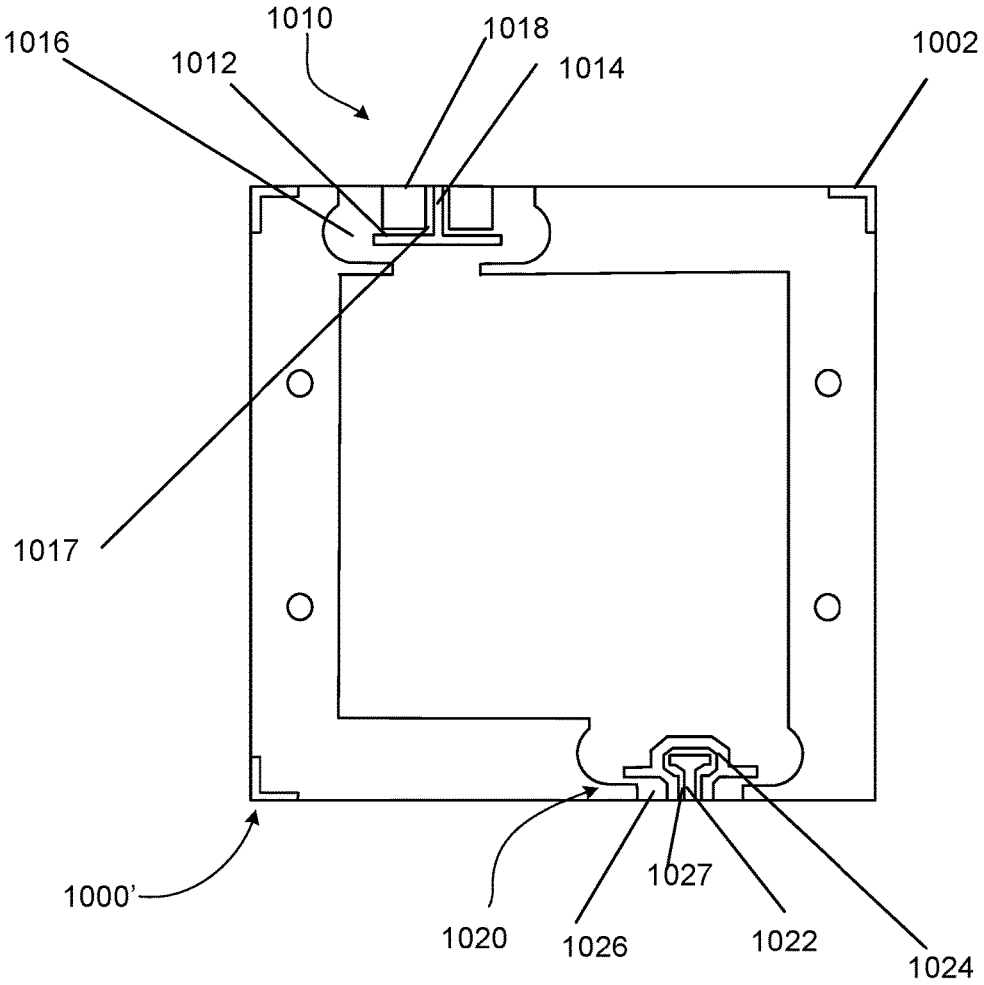

Referring now to FIGS. 11A and 11B, an alternative implementation 1000 of the micro pump with sliding valves is shown. Details are shown for an exemplary sliding valve 1010 (a "T" or "Tau" valve) used on output ports and a sliding valve 1020 (an "Omega valve") used on input ports to the chambers e.g., 209 of the micro pump, e.g., 200 (FIG. 2B) are shown. The "T" or "Tau" valve has a moveable member in the shape of a "T" (or the Greek letter "Tau", whereas the Omega valve has a moveable member in the shape of the Greek letter "Omega."

Recalling that the chamber 209 is produced from the pump body 204 and membranes 206 (FIG. 2B) (or end walls of the pump body). In FIG. 11A, a portion of the material 1000 that is used to produce the pump body 204 provides the T valve 1010 at what would be an output port of a micro pump chamber. The T valve 1010 includes a flat member 1012 that provides a valve to close off the output port and with the flat member 1012 connected to a stem member 1014 that resides in a compartment 1017 formed from regions 1018. Outlets from the chamber are provided by regions 1016.

In FIG. 11A, another portion of the material 1000 that is used to produce the pump body 204 provides the omega valve 1020 at what would be an input port of a micro pump chamber. The omega valve 1020 includes a piston, like member 1022 that provides a stop for the omega shaped member 1024 that is somewhat semi-circular with horizontal arms 1024*a* that provides a valve to close off the input port and with the omega shaped member 1024 having vertical arms 1024*b*. The omega shaped member is confined to the region (not referenced) form between the piston member 1022 and the omega member 1024 by the piston like member 1022. Inlets from the chamber are provided by regions 1026.

Referring now to FIG. 11B the etched body 1000' has the sliding valve 1010 ("T valve") on output ports and the sliding valve 1020 ("omega valve") on input ports and which are formed by removing excess material from the material of the body guided by the etch lines 1002, as shown, leaving each of the sliding valves 1010 and 1020 to move freely within very confined regions, according to pressure applied to the chamber but not being free to move outside of the confined regions. As shown in FIG. 11B, dicing of the pump body along dicing lines defined by etch lines in the corners will separate the piston like member 1022 from the body and the stem of the T member from the body. The T valve 1010 has the flat member 1012 close off the output port, and is confined in the region defined by 1016 and 1017, whereas the mega valve 1020 is confined by the region 1026 and region 1027.

Figure 11C:
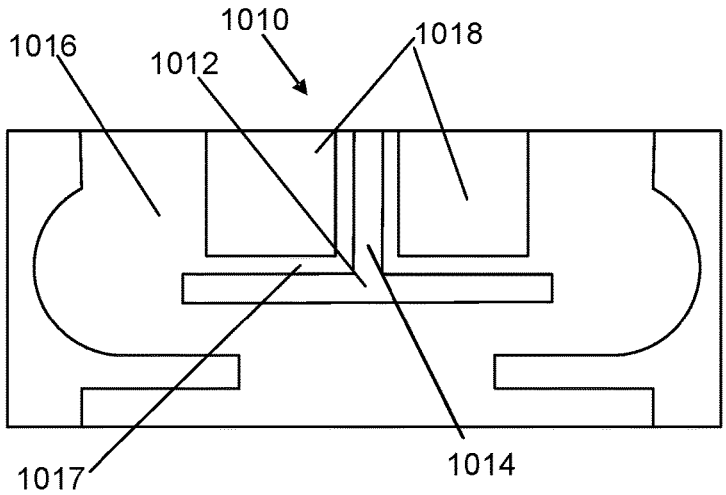
Figure 11D:
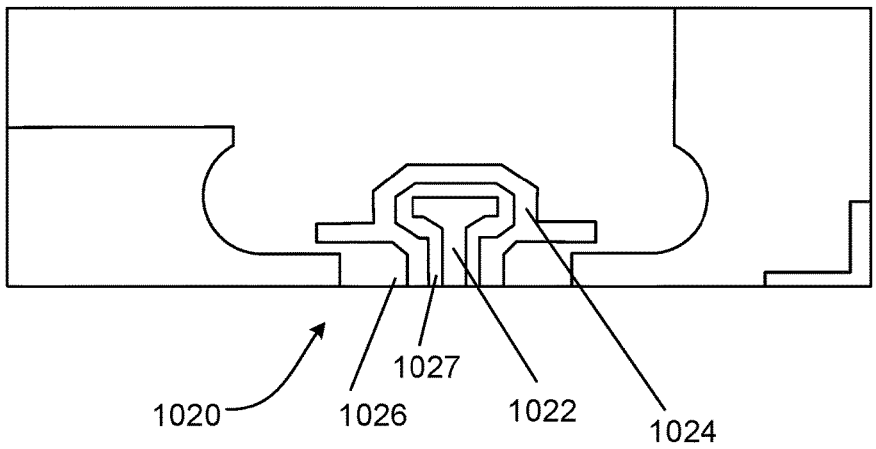

FIGS. 11C and 11D show the sliding valve 1010 ("T valve") on output ports and the sliding valve 1020 ("omega valve") on input ports at a higher magnification.

In some implementations, the micro pump systems can also be used to sense distance between membranes by measuring capacitance between the membranes. The micro pumps include electrodes, each pair of which forming an electrostatic actuator, which is effectively a variable capacitor having two conductive plates, i.e., the electrodes, spaced apart at some distance. When a voltage is applied across the two electrodes, the electrodes move towards or away from each other. As the distance between the electrodes changes, so does the capacitance. The capacitance increases as the electrodes move closer and decreases as the electrodes move apart. Accordingly, the capacitance between a pair of electrodes can provide information about the distance between the pair.

In some implementations, the information can be applied to determining a number of parameters of the system. For example, quantities including pressure, volume, flow rate, and density can be measured. A sacrificial filling material is used in R2R processing described below. In some implementations, solvents are used in the manufacturing process, which may place additional requirements on the various other materials of the micro pump. In some implementations electrical circuit components are printed into the membranes. A release material is used for enabling flap movement of the flap valves. In general, while certain materials have been specified above, other materials having similar properties to those mentioned could be used.

Roll to Roll Processing for Producing Micro Pumps and Flap Valves

Figure 12:
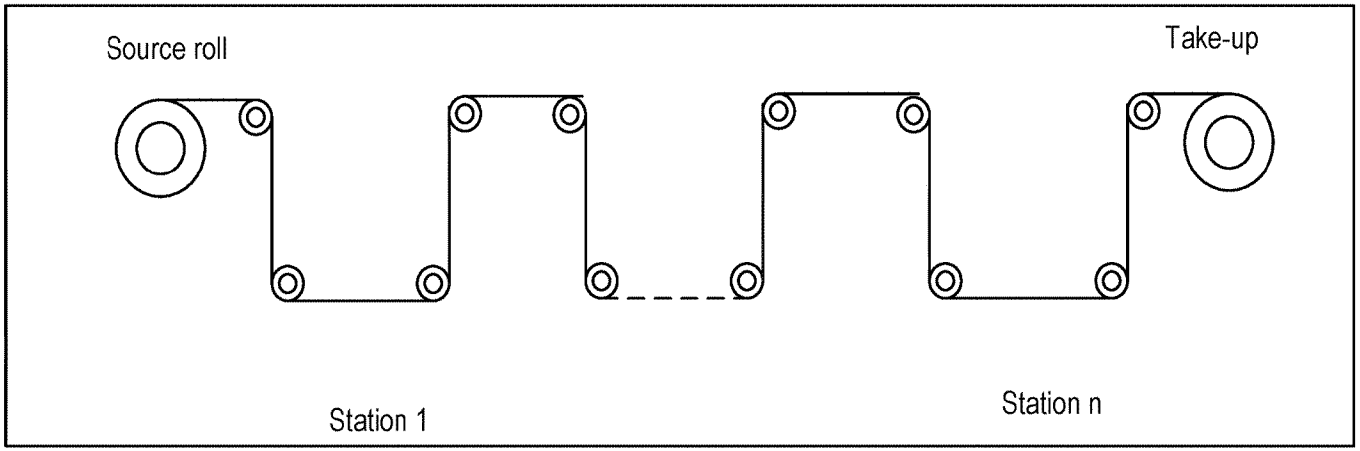
FIG. 12 is a conceptual diagram of a roll to roll processing configuration.

Referring to FIG. 12, a conceptual view of a roll to roll processing line is illustrated. The processing line comprises several stations, e.g., station 1 to station n (that can be or include enclosed chambers) at which deposition, patterning, and other processing occurs. Processing viewed at a high level thus can be additive (adding material exactly where wanted) or subtractive (adding material and removing material in places where wanted). Deposition processing includes evaporation, sputtering, and/or chemical vapor deposition (CVD), as needed, as well as printing. The patterning processing can include depending on requirements techniques such as scanning laser and electron beam pattern generation, machining, optical lithography, gravure and flexographic (offset) printing depending on resolution of features being patterned. Ink jet printing and screen printing can be used to put down functional materials such as conductors. Other techniques such as imprinting and embossing can be used.

The original raw material roll is of a web of flexible material. In roll to roll processing the web of flexible material can be any such material and is typically glass or a plastic or a stainless steel. While any of these materials (or others) could be used, plastic has the advantage of lower cost considerations over glass and stainless steel and is a biocompatible material for production of the micro-pump when used in the CPAP type (continuous positive airway pressure) breathing device (FIG. 9). In other applications of the micro-pump, e.g., as a cooling component for electronic components other materials such as stainless steel or other materials that can withstand encountered temperatures would be used, such as Teflon and other plastics that can withstand encountered temperatures.

Figure 12A:
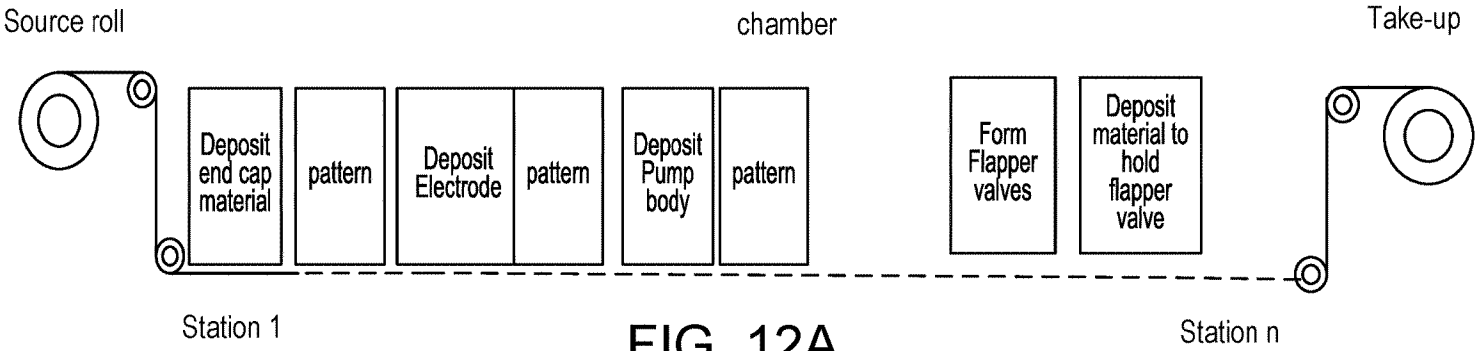
FIG. 12A is a conceptual view of some of the exemplary roll to roll processing stations for the structure of FIG. 2B.

Referring now to FIG. 12A, for the structure shown in FIGS. 2A-2D, stations within a roll to roll processing structure are set up according to the processing required. Thus, while the pump end cap and top caps could be formed on the web or plastic sheet of FIG. 12, in one implementation the end and top caps are provided after formation of the micro-pump stack, as will be described.

The plastic web is used to support the pump body 204 (FIG. 2B) by a deposition of material on the web at a deposition station 280 followed by patterning station 282. The pump body 204 and stopper 218 and a flap 220 for flap valves 214 (FIG. 2B) are formed in the pump body 204 at a forming station 284. In one implementation a station 286 is provided to deposit sacrificial material to hold the flaps to the body. The web having the pump body 204 and formed flaps 220 for flap valves 214 (FIG. 2A) has a membrane deposited over the pump body 204 at a station 290. Over the membrane 206 is deposited an electrode 210 at deposition station 292 which is patterned at patterning station 294.

The flap 220 has one end 222 attached to the pump body 204 and another end 224 movable relative to the stopper 218 and the pump body 204. The flaps are formed in the pump body using the same material as used for the pump body. The material for the flaps 220, 232 needs to be strong or stiff enough to hold its shape, yet elastic enough to allow the flaps 220, 232 to move as desired. The material is etchable or photo sensitive so that its features can be defined and machined/developed. The material interacts, e.g., adheres, with the other materials in the micro pump, e.g., via polymeric or ultrasonic welding. Furthermore, the material is electrically non-conductive. Examples of suitable materials include SU8 (negative epoxy resist), and PMMA (Polymethyl methacrylate) resist.

Over the pump body is applied a membrane sheet 206 with patterned electrodes 210 supported on the membrane 206. Electrical interconnects for conducting the drive voltages to the electrodes 206 on each membrane are provided by depositing conductive materials, e.g., gold, silver, and platinum layers (or conductive inks such as silver inks and the like). In some implementations some of the electrical circuit components are printed onto the membranes.

In manufacturing the micro pump, the sacrificial filling material that can be employed is, e.g., polyvinyl alcohol (PVA). The sacrificial filling material can be used, if needed, to support the membrane over the pump body during processing. Solvents then would be used in the manufacturing process to subsequently remove this sacrificial filling material.

The roll having the micro-pump units (pump body and membrane with electrode and electrical connections) are diced and the micro-pump units are collected, assembled into stacks of micro-pump units, and packaged by including the end and top caps to provide micro-pumps (e.g., of FIG. 2A). Depending upon the layout of the pump units on the web it may be possible to fold the web of the pump units into a stack of pump units, with electrodes provided on the membrane layer.

The membrane material is required to bend or stretch back and forth over a desired distance and thus should have elastic characteristics. The membrane material is impermeable to fluids, including gas and liquids, is electrically non-conductive, and possesses a high breakdown voltage. Examples of suitable materials include silicon nitride and Teflon.

The material of the electrodes is electrically conductive. The electrodes do not conduct significant current. The material can have a high electrical resistance, although the high resistance feature is not necessarily desirable. The electrodes are subject to bending and stretching with the membranes, and therefore, it is desirable that the material is supple to handle the bending and stretching without fatigue and failure. In addition, the electrode material and the membrane material adhere well, e.g., do not delaminate from each other, under the conditions of operation. Examples of suitable materials include, e.g., gold, silver, and platinum layers (or conductive inks such as silver inks and the like). A release material can be used for allowing for valve movement. Suitable release materials include, e.g., the sacrificial filling material mentioned above.

Referring to FIGS. 13A-13D, an alternative roll to roll processing approach to provide the modularized micro pump 200 (FIG. 2A) is shown. The micro-pump 200 has features that are moveable in operation and may be release-able from carriers during manufacture. These features include the membrane (which flexes) and the flaps (on flap valves that bend or swing) or alternatively the slide-able valves of (FIGS. 12A-12D) that can be released. In this discussion the focus will be on valves having features that slide and be released (the Tau and Omega portions of the Tau and Omega valves of FIGS. 12A-12D). Other types of microelectromechanical systems that can be produced in the roll to roll processing line using the techniques disclosed herein would have other features that are moveable in operation, e.g., rods or gears that are examples of features that slide and rotate, respectively. These features are also released during processing, as described below.

The micro pump 260 is fabricated using roll to roll processing where a raw sheet (or multiple raw sheets) of material is passed through plural stations to have features applied to the sheet (or sheets) and the sheet (or sheets) are subsequently taken up to form parts of the repeatable composite layers (See FIGS. 2A-2D) to ultimately produce a composite sheet of fabricated micro-pumps (or other structures having moveable and/or release-able features). In the implementation of micro pump of FIGS. 12A-12B, the roll to roll processing provides features that are freely moveable (e.g., free to move) within constructed microelectromechanical systems.

Referring to FIG. 13A, a sheet 304 of a flexible material such as a glass or a plastic or a stainless steel is used as a web. For the particular implementation of the micro-pump (either the micro-pump 200 (FIGS. 2A-2D) with sliding valves or with flap valves), the material is a plastic sheet, e.g., Polyethylene terephthalate (PET), which is provided with a layer 304*a* of metal e.g., aluminum (Al) over a major surface of the sheet 304.

The sheet 304 is a 50 micron thick sheet of PET (Teflon) that coated with a thin metal layer 304*a* of aluminum having a 100 A° (Angstroms) thickness. Other thicknesses could be used (e.g., the sheet 304 could have a thickness between, e.g., 25 microns and 250 microns (or greater) and the thickness of the layer 304*a* can be 50 A° to 500 A° (or greater). The thicknesses are predicted on desired properties of the microelectromechanical system to be constructed and the handling capabilities of roll to roll processing lines. These considerations will provide a practical limitation on the maximum thickness. Similarly, the minimum thicknesses are predicted on the desired properties of the microelectromechanical system to be constructed and the ability to handle very thin sheets in roll to roll processing lines.

For the example where the microelectromechanical system is the micro pump, the layers would have thicknesses as mentioned above approximately 50 microns for the pump body and 5 microns for the membrane elements of the micro pump 200. However, other thicknesses are possible even for the micro pump. The metal layer 304*a* is provided by various approaches, such as evaporation or other techniques. Such metalized films are also commercially available.

The sheet 304 from a roll (not shown) with the layer 304*a* of metal is patterned at an ablation station, e.g., a laser ablation station 1. A mask (not shown) is used to configure the laser ablation station to remove the metal layer 304*a* from those portions of the sheet 304 that will be used to form the micro pump units, i.e., the body, the regions 1018, the regions 1022 and 1024*b*, while leaving metal 304' only on portions of the sheet that will ultimately become moveable parts, which in the case of the micro pump with sliding valves (as shown in FIGS. 11A-11D) are the "T" (or Tau) (1017, FIG. 11C) and the "omega" shaped members (1026, FIG. 11D) of the Tau and Omega valves respectively, as shown in detail in FIG. 13A-1. Optionally, the metal 304' can also be left on those extraneous portions of the sheet where the various structures are not fabricated, in order to same time/expense in unnecessary ablation as shown in detail in FIG. 13A-1.

The metal left on the sheet portions that will become Tau portion of the Tau valve and the Omega portion of the Omega valve permit those features to move within the respective valves. This technique relies on the recognition that during lamination of plastic layers as discussed below, the plastic will not laminate to the metal based on conditions that will be employed by subsequent lamination techniques. However, under these conditions the plastic will stick to underlying plastic. The defined conditions include heat, pressure and time that during lamination are sufficient to cause the plastic to stick to the underlying plastic by an electrostatic mechanism without melting the PET.

Figure 13B:
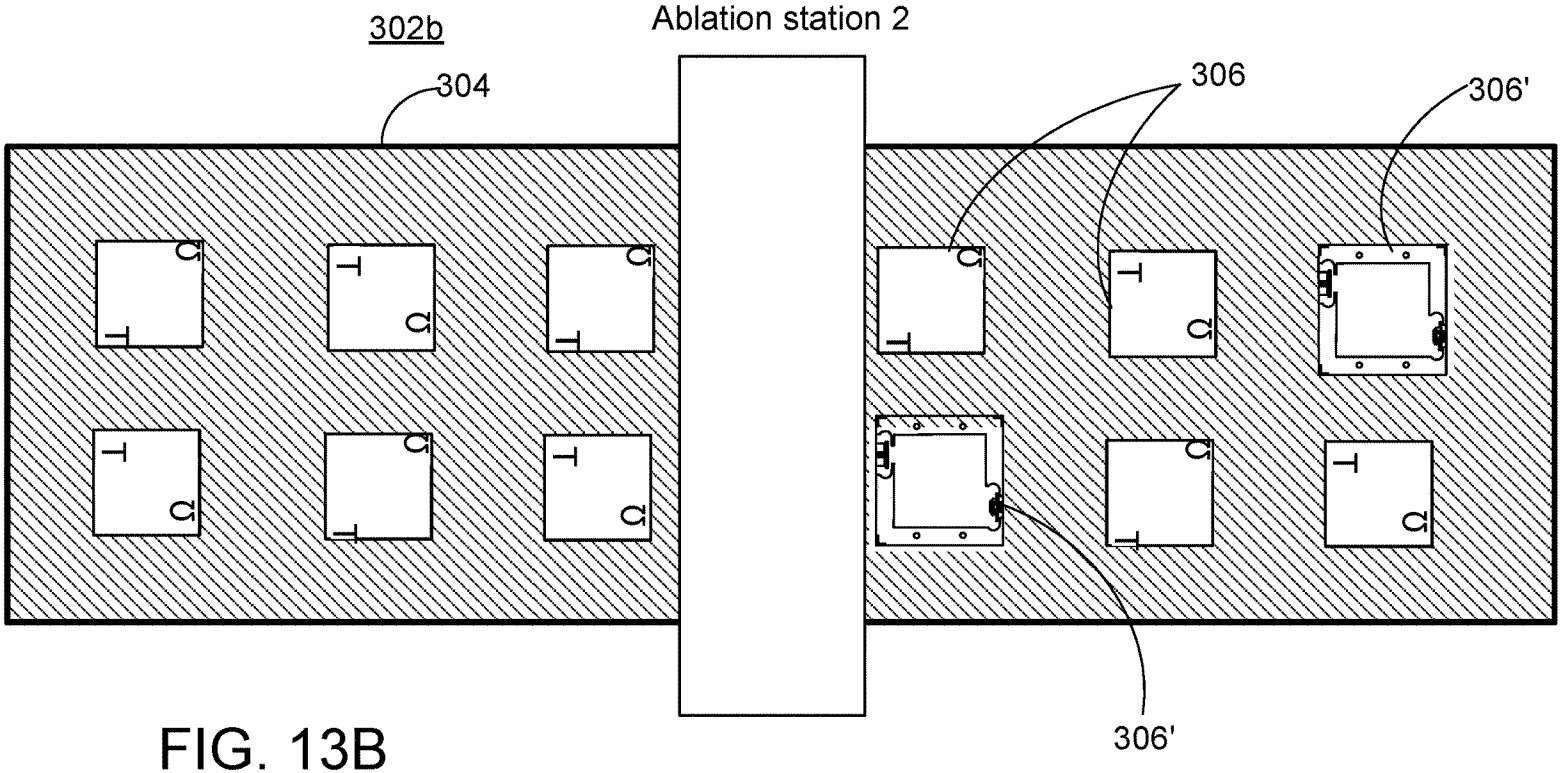

Referring now to FIG. 13B, the sheet 304 with the metal left 304*a*' on sheet portions that will align to the T portion (1017, FIG. 12D) of the T valve and the omega portion (1026, FIG. 12D) of the omega valve, and optionally on the extraneous portions, is micro-machined. A second mask (not shown) is used to configure a second laser ablation station to define or form the compartment and valve members (denoted as regions 306 in FIG. 13B) of the micro pump of FIGS. 11A-11D, as well as alignment holes (not shown but will be discussed below). Vias are also provided for electrical connections, as shown. The micro-machining ablates away the plastic to form the compartment of the micro pump while leaving the frame portion of the pump body and also forms the containment structures for the valves as generally shown for item 306'.

Figure 13C:
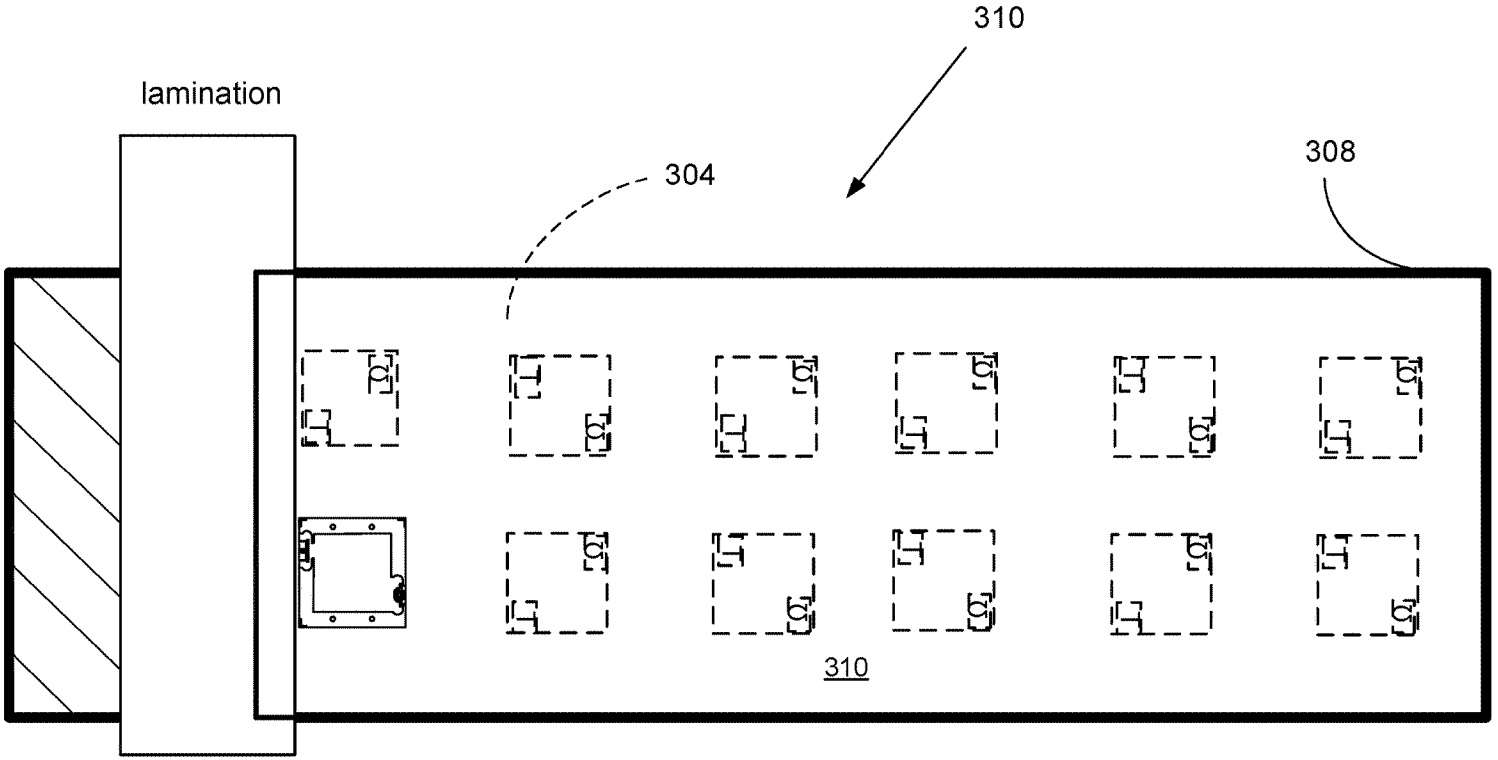

Referring now to FIG. 13C, the sheet 304 with the defined features of the T portion (1017, FIG. 12D) of the T valve and the omega portion (1026, FIG. 12D) of the omega valve, and the compartment is laminated at a lamination station to a second sheet 308, e.g., 5 micron thick sheet of PET, with a second metallic layer 310 of Al of 100 A on a top surface of the sheet. This second sheet 308 forms the membranes over the pump bodies provided by the defined features of the compartment and valve regions. The second sheet is also machined to provide the alignment holes (not shown) prior to or subsequent to coating of the metallic layer.

Prior to lamination of the second sheet 308 to the first sheet 304, the second sheet 308 is also provided with several randomly dispersed holes (not shown) over some areas that will be in alignment with the pump bodies structures. These randomly dispersed holes are used by a machine vision system to reveal and recognize underlying features of the pump body units on the first sheet 304. Data is generated by noting the recognized features in the first sheet through the random holes. These data will be used to align a third ablation station when forming electrodes from the layer over the pump bodies (discussed below) and metallic pads in regions over the Tau and Omega features.

The second sheet 308 is laminated to and thus sticks (or adheres) to the first sheet 304 in areas where there is plastic on the first sheet 304 and plastic on the second sheet 308, but does not adhere or stick to the first sheet 304 where there is metal on the first sheet 304 and plastic on the second sheet 308. This selective sticking results because the lamination conditions discussed above. This permits the moveable members in the micro pump to freely move, e.g., the Tau and Omega structures of FIGS. 12A-12D.

At this point, a composite sheet 310 of repeatable units of the micro pump, e.g., pump body and movable and releasable features, with membranes are formed, but without electrodes formed from the layer on the membrane. This selective sticking provided by the use of metal on features that would come in contact with the sheet can be used to provide other moveable features such as flaps on flap valves, beams, cantilevered structures, gears, etc., in other microelectromechanical systems that include such moveable features.

The machine vision system produces a data file that is used by the laser ablation system in aligning a third laser ablation station with a fourth mask such that a laser beam from the laser ablation system provides the electrodes 210 (FIG. 2B) according to the fourth mask, with the electrodes in registration with the corresponding portions of the pump bodies. The electrodes are formed by ablating away the metal in regions that are not part of the electrodes and conductors, leaving isolated electrodes and conductors on the sheet. The registration of the patterned electrodes to the pump body is thus provided by using the machine vision system to observe features on the front side of the laminated structure providing positioning data that the laser ablation system uses to align a laser beam with the fourth mask, using techniques commonly found in the industry.

Figure 13D:
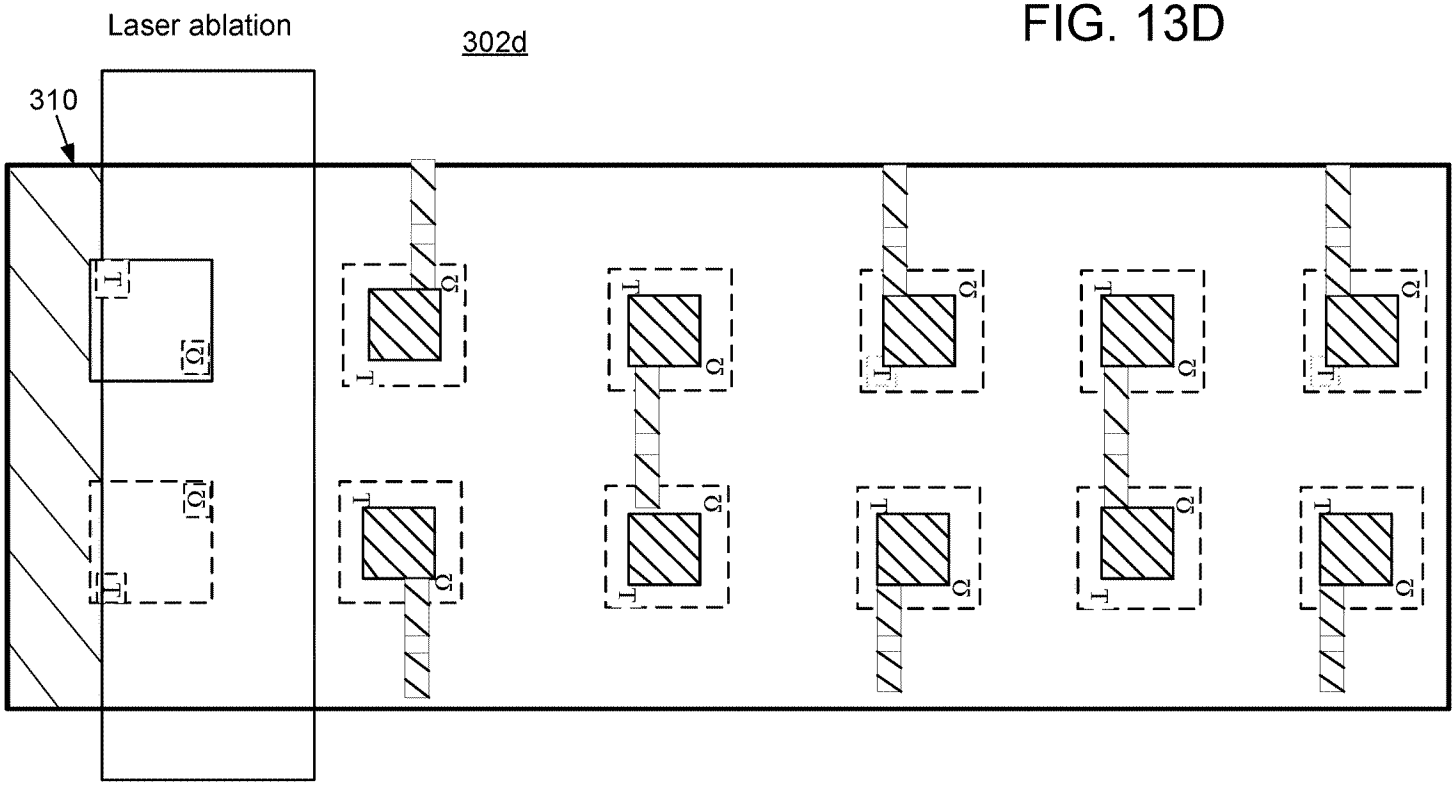

Referring now to FIG. 13D, the composite sheet 310 is fed to a third laser ablation station, to form the electrodes by ablating the 100 A° Al layer deposited on the second sheet that formed the membrane. The composite sheet 310 is patterned according to a fourth mask (FIG. 14) to define the electrodes over corresponding regions of the pump body. The third ablation station ablates away metal from the second layer leaving isolated electrodes on the sheet.

Figure 14:
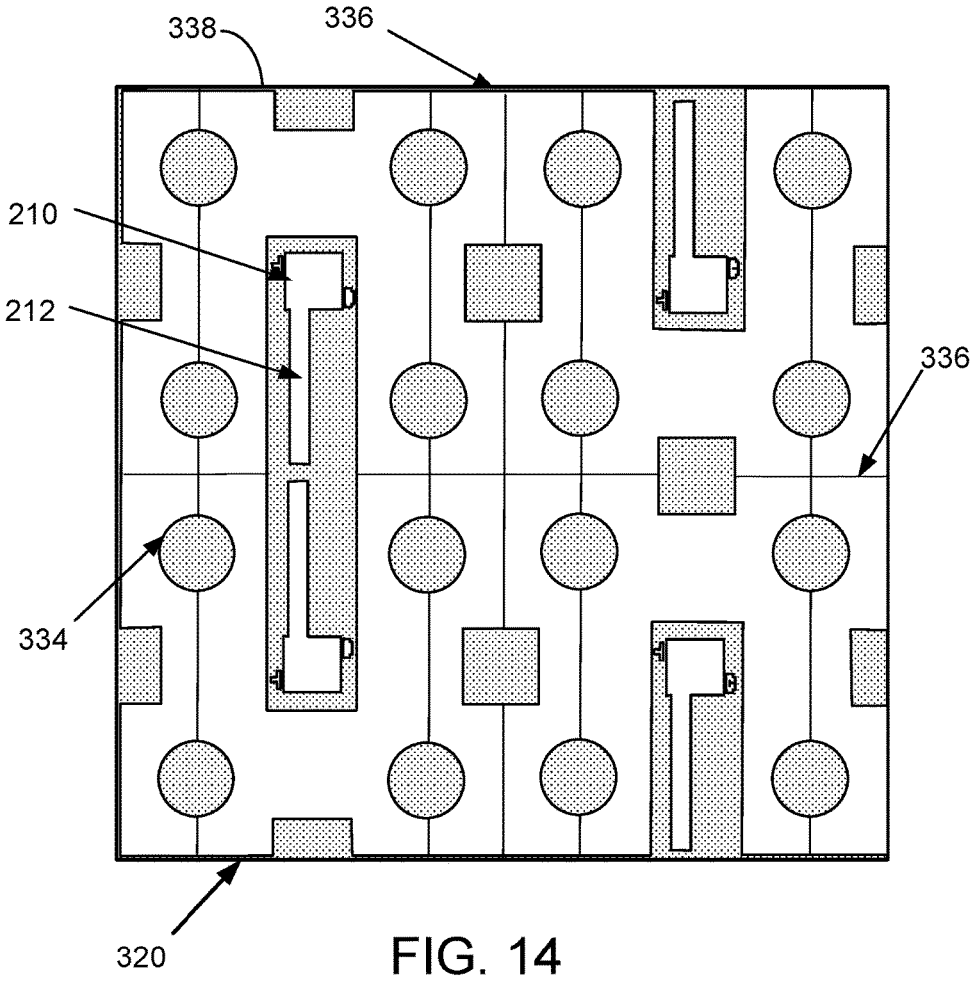
FIG. 14 is a view of a mask.

Referring now to FIG. 14, the fourth mask 320 used to configure the third laser ablation station to provide the electrodes 210 (FIG. 2B) is shown. This fourth mask can be viewed as showing the electrodes 210 (FIG. 2B) and conductors 212 (FIG. 2B) on the membrane, alignment holes 334, and cut lines 336. This composite sheet 320 with the electrodes (FIG. 13D) is fed to a station (not shown) where the sheet is cut along cut lines 336, as shown in FIG. 14. The alignment holes 334 provided from each of the processing steps of FIGS. 13A-13D are used to provide a mechanism to align each of dies cut from these sheets to produce a stack of such pump bodies as in FIG. 2D.

A jig (not shown) that can comprises vertical four posts mounted to a horizontal base is used to stack individual ones of the cut dies. On the jig an end cap (e.g., a 50 micron PET sheet with a metal layer) is provided and over the end cap a first repeatable unit is provided. The repeatable unit is spot welded (applying a localized heating source) to hold the unit in place on the jig. As each repeatable unit is stacked over a previous repeatable unit that unit is spot welded. The stack is provided by having the T values on one side of the stack and the Omega valves on the other of the stack, and staggered resulting from arrangement of the valves so as to have a solid surface separating each of the values in the stack (See FIG. 2D). Once a stack is completed, a top cap (not shown) can be provided. The stack unit is sent to a lamination station not shown, where the stack is laminated, laminating all of the repeatable units and caps together. The end cap and top cap can be part of the packaging as well. Otherwise sets of repeatable units can be laminated in pairs.

The modularized micro pump 260 is comprised of module layers to form end compartments of the pump 260. The module layers each include a pump end cap forming a fixed pump wall (similar to walls 106, 108 FIGS. 1A, 1B). An electrode is attached to the pump end cap for activating the compartment. The electrode includes a lead (not shown) to connect to a drive circuit (not shown). After lamination of the stack, the stack units are diced to form individual micro pumps.

Other stacking techniques for assembly are possible with or without the alignment holes 334.

Elements of different implementations described herein may be combined to form other embodiments not specifically set forth above. Elements may be left out of the structures described herein without adversely affecting their operation. Furthermore, various separate elements may be combined into one or more individual elements to perform the functions described herein. Other embodiments are within the scope of the following claims.

What is claimed is:

1. A method of manufacturing a microelectromechanical system, the microelectromechanical system comprising a fixed body and an element that is releasable from the body, and once released, is moveable relative to the fixed body, the method comprising:

patterning a metal coating on a first surface of a first sheet of a flexible plastic material to remove the metal coating from a first portion of the surface of the first sheet, while leaving a first metallic region on a second portion of the surface of the sheet;

patterning the first sheet to produce the fixed body from the first portion of the sheet, and the element from the second portion of the first sheet, with the element having the first metallic region, and a tether that tethers the element to a portion of the fixed body; and laminating a second sheet of a flexible plastic material to the first sheet to provide a composite laminated structure.

2. The method of claim 1 wherein the microelectromechanical system is a micro-pump, and the fixed body is a pump body and the element is a moveable element of a valve.

3. The method of claim of 2 wherein the at least one metal region is a first metal region the element is a first element, and patterning the metal coating further comprises:

ablating the metal coating to leave the first metal region and a second metal region on the first sheet; and wherein patterning the first sheet further comprises:

patterning the first sheet to produce from a third portion of the sheet, a second element that is releasable from the fixed body, and once released is moveable relative to the fixed body, with the second element having the second metallic region and a tether that tethers the second element to a second portion of the fixed body.

4. The method of claim 1 wherein patterning of the first sheet comprises:

ablating the metal coating to leave the at least one metal region.

5. The method of claim 1, further comprising:

depositing on a first surface of the second sheet, a conductive layer that provides an electrode on the first surface of the second sheet.

6. The method of claim of 1 wherein the second sheet has a conductive layer on a first surface of the second sheet.

7. The method of claim of 1 wherein the microelectromechanical system is fabricated on a roll to roll processing line, and the method further comprising:

removing the first sheet of the flexible plastic material having the metal coating from a first roll; and removing the second sheet of the flexible plastic material having a metal coating on one surface from a second roll; and wherein patterning of the metal coating on the first sheet includes ablating and patterning of the first sheet includes ablating.

8. The method of claim 1 wherein the second sheet has a conductive layer on a first surface of the second sheet; the method further comprising:

patterning the conductive layer on the second sheet to provide isolated regions of the conductive layer that provide an electrode on the second sheet.

9. The method of claim 1 wherein a plurality of fixed bodies including the fixed body the element and an additional element are provided by patterning the metal coating and patterning the sheet and laminating the second sheet provides a plurality of composite laminated structures including the composite laminated structure, with the method further comprising:

dicing the composite laminated structures into individual dies;

stacking the individual dies to produce a stacked structure; and laminating the stacked structure to produce a component of the microelectromechanical system.

10. The method of claim 1 wherein the microelectromechanical system is a micro-pump, and the fixed body is a pump body, and the element is a valve element of a valve; with patterning of the metal coating further comprising producing a second metallic region on the first sheet, and patterning the first sheet providing another element that is releasable from the pump body and once released is moveable, relative to the pump body, with the first and second elements being valve elements of valves at an inlet and an outlet of the pump body.

11. The method of claim 1 wherein laminating the second sheet to the first sheet adheres the second sheet to the first sheet at the first portion of the first sheet.

12. The method of claim 1 wherein laminating the second sheet to the first sheet adheres the second sheet to the first sheet at the first portion of the first sheet, and leaves the first metallic region on the first sheet not adhered to the second sheet.

13. A method of manufacturing a microelectromechanical system in a roll to roll processing line, the method comprising:

unrolling from a first roll, a first sheet of a flexible material having a metal coating on one surface of the sheet;

patterning the first sheet to remove the metal coating from a first portion of the surface of the first sheet, while leaving a first metallic region on a second portion of the surface of the sheet;

producing at a first patterning station a body element from the first portion of the first sheet and an element that is releasable from the body, and once released is moveable relative to the body from the second portion of the first sheet of material;

unrolling from a second roll, a second sheet of a flexible material;

laminating at a laminating station the first sheet to the second sheet, with the first and second sheets adhering together in the first regions but the second sheet not adhering to the first metallic region on the first sheet.

14. The method of claim 13 wherein the microelectromechanical system is a micro-pump and the element is a valve element of a valve.

15. The method of claim 13 wherein the microelectromechanical system is a micro-pump, the body is a pump body, the element is a first element, and the micro pump further includes a second element that is releasable and moveable and, with the first and second elements being valve elements of valves at inlets and outlets of the pump body.

16. The method of claim 13 further comprising:

applying a sacrificial filling material to the body element and the element that is moveable and releasable; and after laminating removing the sacrificial filling material with a suitable solvent.

17. The method of claim 13 wherein the first sheet is a web and the body element, and the element this is moveable and releasable are produced from the web.

18. The method of claim 13 further comprising:

unrolling from a third roll, a web of a flexible material that supports on one surface thereof the first sheet.

19. The method of claim 13 wherein the body element is a first body element of a plurality of body elements, each of the body elements having the element that is releasable and moveable and a tether that tethers the element to the body element, and another element that is releasable and moveable and a tether that tethers the another element to the body element, and with the second sheet providing a membrane that is affixed to walls of the body.

20. The method of claim 19 further comprising:

applying a sacrificial filling material to the body elements and the elements that are releasable and moveable;

dicing the first sheet into individual dies of the composite laminated structure that cut a portion of the tether freeing the elements from the body elements;

stacking the individual dies to produce a stacked structure;

laminating the stacked structure; and removing the sacrificial filling material with a suitable solvent.

* * * * *